US007764248B2

(12) United States Patent
Yamamoto et al.

(10) Patent No.: US 7,764,248 B2
(45) Date of Patent: Jul. 27, 2010

(54) DISPLAY AND METHOD FOR DRIVING DISPLAY

(75) Inventors: Tetsuro Yamamoto, Kanagawa (JP); Katsuhide Uchino, Kanagawa (JP); Junichi Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 915 days.

(21) Appl. No.: 11/549,159

(22) Filed: Oct. 13, 2006

(65) Prior Publication Data

US 2007/0115224 A1 May 24, 2007

(30) Foreign Application Priority Data

Oct. 13, 2005 (JP) ..... P2005-298497

(51) Int. Cl.
*G09G 3/12* (2006.01)
*G09G 3/30* (2006.01)

(52) U.S. Cl. ..... 345/36; 345/76; 345/78

(58) Field of Classification Search ..... 345/89
See application file for complete search history.

(56) References Cited

U.S. PATENT DOCUMENTS 5,001,481 A * 3/1991 Lee ..... 341/136
6,750,924 B2 * 6/2004 Murade ..... 349/38
2004/0070557 A1 * 4/2004 Asano et al. ..... 345/76
2004/0196223 A1 * 10/2004 Kwon ..... 345/82
2004/0263057 A1 * 12/2004 Uchino et al. ..... 313/500
2005/0264228 A1 * 12/2005 Kim ..... 315/169.3
2006/0061560 A1 * 3/2006 Yamashita et al. ..... 345/204

FOREIGN PATENT DOCUMENTS

JP 2004-361640 12/2004
JP 2005-345722 12/2005

* cited by examiner

*Primary Examiner*—Richard Hjerpe
*Assistant Examiner*—Dorothy Webb
(74) *Attorney, Agent, or Firm*—Sonnenschein Nath & Rosenthal LLP

(57) ABSTRACT

In a display in which pixel circuits each including a drive transistor, switching transistors and a capacitor are arranged in rows and columns, two-stage mobility correction is implemented in which mobility correction with an intermediate grayscale level (gray level) is executed before mobility correction is executed with an input signal (Vsig) level being written to the gate of the drive transistor when the switching transistor is in the conducting state. Thus, even if the mobility correction period is constant, mobility correction can be implemented for all the grayscales within the mobility correction period. This feature allows achievement of a uniform image quality free from streaks and unevenness attributed to variation in the mobility from pixel to pixel.

8 Claims, 18 Drawing Sheets

DISPLAY AND METHOD FOR DRIVING DISPLAY

CROSS REFERENCES TO RELATED APPLICATIONS

This application contains subject matter related to Japanese Patent Application JP 2005-298497 filed with the Japanese Patent Office on Oct. 13, 2005, the entire contents of which being incorporated herein by reference.

BACKGROUND OF THE INVENTION

1. Field of the Invention

The present invention relates to a display and a method for driving a display, and particularly to a display in which pixel circuits each including an electro-optical element are arranged in rows and columns (in a matrix), and a method for driving the display.

2. Description of Related Art

In recent years, development and commercialization of organic electro luminescence (EL) displays have been advanced. In the organic EL display, a large number of pixel circuits are arranged in a matrix, and each pixel circuit includes an organic EL element, which is a so-called current-driven light-emitting element of which emission luminance varies depending on the current value, as an electro-optical element. Since the organic EL element is a self-luminous element, the organic EL display has advantages such as high image visibility, no backlight, and high response speed over a liquid crystal display, which controls the intensity of light from a light source (backlight) by use of pixel circuits each including a liquid crystal cell.

As the driving system for the organic EL display, a simple-(passive) matrix system or an active-matrix system can be employed, similarly to the liquid crystal display. However, a display of the simple-matrix system involves a problem that it is difficult to realize a large-size and high-definition display and other problems although the configuration thereof is simple. For that reason, in recent years, development of displays of the active-matrix system has been actively promoted. In the active-matrix display, the current flowing through a light-emitting element is controlled by an active element such as an insulated gate field effect transistor (typically, thin film transistor; TFT) provided in the same pixel circuit as that including the light-emitting element.

If N-channel transistors can be used as the thin film transistors (hereinafter, referred to as TFTs) that are included in pixel circuits as active elements, an existing amorphous silicon (a-Si) process can be used in fabrication of the TFTs. The use of an a-Si process can reduce costs of the TFT substrate.

In general, the current-voltage (I-V) characteristic of an organic EL element deteriorates as the time passes (deteriorates with age). In a pixel circuit including N-channel TFTs, the source of the TFT for current-driving the organic EL element (hereinafter, referred to as a drive TFT) is connected to the organic EL element. Therefore, age deterioration of the I-V characteristic of the organic EL element leads to a change in the gate-source voltage Vgs of the drive TFT, which results in a change in the emission luminance of the organic EL element.

A more specific description will be made on this point. The source voltage of the drive TFT is determined depending on the operating point of the drive TFT and organic EL element. Deterioration of the I-V characteristic of the organic EL element varies the operating point of the drive TFT and organic EL element. Therefore, even when the same gate voltage is applied to the drive TFT, the source voltage of the drive TFT varies. Thus, the gate-source voltage Vgs of the drive TFT varies, and hence the value of the current flowing through the drive TFT varies. Accordingly, the value of the current flowing through the organic EL element also varies, which results in variation in the emission luminance of the organic EL element.

Furthermore, in addition to the age deterioration of the I-V characteristic of the organic EL element, the pixel circuit including N-channel TFTs involves a change in the threshold voltage Vth of the drive TFT with time and variation in the threshold voltage Vth from pixel to pixel. The difference in the threshold voltage Vth of the drive TFT leads to variation in the value of the current flowing through the drive TFT. Accordingly, even when the same gate voltage is applied to the drive TFT, the emission luminance of the organic EL element varies.

An existing related art employs a configuration in which each of pixel circuits is provided with a function to compensate variation in the characteristic of the organic EL element and a function to compensate variation in the threshold voltage Vth of the drive TFT so that the emission luminance of the organic EL element is not affected but kept constant even when the I-V characteristic of the organic EL element deteriorates with age and the threshold voltage Vth of the drive TFT changes over time (refer to e.g. Japanese Patent Laid-open No. 2004-361640). The related art according to this patent document will be described below.

FIG. 1 is a circuit diagram showing the configurations of an active-matrix display and pixel circuits used in the display according to the related art. The active-matrix display of the related art includes a pixel array 102 in which a large number of pixel circuits 101 each including a current-driven light-emitting element such as an organic EL element are arranged in a matrix. FIG. 1 shows the specific circuit configuration of certain one pixel circuit 101 for simplified illustration.

In the pixel array 102, scan lines 103, first and second drive lines 104 and 105, and auto-zero lines 106 are provided for the respective pixel circuits 101 on each row basis. Furthermore, data lines 107 are provided on each column basis. Arranged in the periphery of the pixel array 102 are a write scanning circuit 108 that drives the scan lines 103, first and second drive scanning circuits 109 and 110 that drive the first and second drive lines 104 and 105, respectively, an auto-zero circuit 111 that drives the auto-zero lines 106, and a data line drive circuit 112 that supplies the data lines 107 with data signals dependent upon luminance information.

The pixel circuit 101 includes, as its components, an organic EL element 201, a drive transistor 202, capacitors (storage capacitors) 203 and 204, a sampling transistor 205 and switching transistors 206 to 209. As the drive transistor 202, the sampling transistor 205 and the switching transistors 206 to 209, e.g. N-channel field effect TFTs are used. Hereinafter, the drive transistor 202, the sampling transistor 205 and the switching transistors 206 to 209 are referred to as a drive TFT 202, a sampling TFT 205 and switching TFTs 206 to 209, respectively.

The cathode electrode of the organic EL element 201 is coupled to a ground potential GND. The drive TFT 202 is a transistor that drives the organic EL element 201 to emit light, and the source thereof is connected to the anode electrode of the organic EL element 201, which leads to formation of a source follower circuit. The capacitor 203 is a storage capacitor. One electrode thereof is connected to the gate of the drive TFT 202, while the other electrode thereof is connected to a connecting node N101 between the source of the drive TFT 202 and the anode electrode of the organic EL element 201.

One terminal of the sampling TFT 205 is connected to the data line 107, the other terminal thereof is coupled to the gate of the drive TFT 202, and the gate thereof is connected to the scan line 103. One electrode of the capacitor 204 is connected to a node N104, while the other electrode thereof is connected to a connecting node N102 between the gate of the drive TFT 202 and one electrode of the capacitor 203. The drain of the switching TFT 206 is connected to the connecting node N101, and the source thereof is coupled to a supply potential Vss.

The drain of the switching TFT 207 is coupled to a positive supply potential Vcc, the source thereof is connected to the drain of the drive TFT 202, and the gate thereof is connected to the second drive line 105. One terminal of the switching TFT 208 is connected to a connecting node N103 between the drain of the drive TFT 202 and the source of the switching TFT 207, the other terminal thereof is connected to the connecting node N102, and the gate thereof is connected to the auto-zero line 106. One terminal of the switching TFT 209 is coupled to a predetermined potential Vofs, the other terminal thereof is connected to the node N104, and the gate thereof is connected to the auto-zero line 106.

In the following, a description will be made on the circuit operation of an active-matrix organic EL display in which the pixel circuits 101 each having the above-described configuration are two-dimensionally arranged in a matrix with reference to the timing chart of FIG. 2.

When the pixel circuit 101 on a certain row is driven, a write signal WS is supplied to the pixel circuit 101 from the write scanning circuit 108 via the scan line 103, and first and second drive signals DS1 and DS2 are supplied to the pixel circuit 101 from the first and second drive scanning circuits 109 and 110 via the first and second drive lines 104 and 105, respectively. Furthermore, an auto-zero signal AZ is supplied to the pixel circuit 101 from the auto-zero circuit 111 via the auto-zero line 106. FIG. 2 shows the timing relationship among these signals.

In a normal emission state, the write signal WS output from the write scanning circuit 108, the drive signal DS1 output from the first drive scanning circuit 109, and the auto-zero signal AZ output from the auto-zero circuit 111 are at the "L" level, while the drive signal DS2 output from the second drive scanning circuit 110 is at the "H" level. Therefore, the sampling TFT 205 and the switching TFTs 206, 208 and 209 are in the off-state, while the switching TFT 207 is in the on-state.

At this time, the drive TFT 202 operates as a constant current source since it is designed so as to operate in the saturation region. As a result, a constant current Ids expressed by Equation (1) is supplied from the drive TFT 202 to the organic EL element 201.

$$Ids=(1/2)\cdot\mu(W/L)Cox(Vgs-|Vth|)^2 \quad (1)$$

In Equation (1), Vth is the threshold voltage of the drive TFT 202, μ is the carrier mobility, W is the channel width, L is the channel length, Cox is the gate capacitance per unit area, and Vgs is the gate-source voltage.

When the switching TFT 207 is in the on-state, both the drive signal DS1 output from the first drive scanning circuit 109 and the auto-zero signal AZ output from the auto-zero circuit 111 are turned to the "H" level, and hence the switching TFTs 206, 208 and 209 enter the on-state. Thus, the supply potential Vss is applied to the anode electrode of the organic EL element 201, while the supply potential Vcc is applied to the gate of the drive TFT 202.

At this time, if the supply potential Vss is lower than the sum between the cathode voltage Vcat of the organic EL element 201 (ground potential GND, in this example) and the threshold voltage Vthel of the organic EL element 201 (Vcat+Vthel), the organic EL element 201 becomes the non-emission state, which starts the non-emission period. The following description is based on an assumption that the relationship Vss≦Vcat+Vthel is satisfied and the supply potential Vss is at the GND level. When the non-emission period starts, since the switching TFTs 206 and 208 enter the on-state, the constant current Ids dependent upon the gate-source voltage Vgs flows through the path of Vcc→switching TFT 207→drive TFT 202→node N101→switching TFT 206→Vss.

Subsequently, the drive signal DS2 output from the second drive scanning circuit 110 is turned to the "L" level, so that the switching TFT 207 becomes the off-state and thus the operation time sequence enters a threshold cancel period for canceling (correcting) the threshold voltage Vth of the drive TFT 202. At this time, the drive TFT 202 operates in the saturation region since the gate and drain thereof are coupled to each other via the switching TFT 208. In addition, since the capacitors 203 and 204 are connected to the gate of the drive TFT 202 in parallel to each other, the gate-source voltage Vgs of the drive TFT 202 gradually decreases as the time passes.

After a certain period has passed, the gate-source voltage Vgs of the drive TFT 202 reaches the threshold voltage Vth of the drive TFT 202. At this time, a voltage of (Vofs−Vth) is charged to the capacitor 204, while a voltage of Vth is charged to the capacitor 203. Subsequently, when the sampling TFT 205 and the switching TFT 207 are in the off-state and the switching TFT 206 is in the on-state, the auto-zero signal AZ output from the auto-zero circuit 111 is changed from the H level to the "L" level. Thus, the switching TFTs 208 and 209 enter the off-state, which corresponds to the end of the threshold cancel period. At this time, the capacitor 204 holds the voltage of (Vofs−Vth), while the capacitor 203 holds the voltage of Vth.

Subsequently, when the sampling TFT 205 and the switching TFTs 207, 208 and 209 are in the off-state and the switching TFT 206 is in the on-state, the write signal WS output from the write scanning circuit 108 is turned to the "H" level, which starts a writing period. In the writing period, the sampling TFT 205 is in the on-state, which allows writing of an input signal voltage Vin supplied through the data line 107. Specifically, by turning on the sampling TFT 205, the input signal voltage Vin is loaded onto the connecting node N104 among one terminal of the TFT 205, one electrode of the capacitor 204 and the source of the TFT 209, so that a voltage variation amount ΔV at the connecting node N104 is coupled to the gate of the drive TFT 202 via the capacitor 204.

At this time, the gate voltage Vg of the drive TFT 202 is equal to the threshold voltage Vth, and the coupling amount ΔV is determined depending on the capacitance C1 of the capacitor 203, the capacitance C2 of the capacitor 204, and the parasitic capacitance C3 of the drive TFT 202 as expressed by Equation (2).

$$\Delta V=\{C2/(C1+C2+C3)\}\cdot(Vin-Vofs) \quad (2)$$

Therefore, if the capacitances C1 and C2 of the capacitors 203 and 204 are set sufficiently larger than the parasitic capacitance C3 of the drive TFT 202, the amount ΔV of the coupling to the gate of the drive TFT 202 is not affected by the threshold voltage Vth of the drive TFT 202 but determined depending only on the capacitances C1 and C2 of the capacitors 203 and 204.

When the write signal WS output from the write scanning circuit 108 is changed from the "H" level to the "L" level and hence the sampling TFT 205 is turned off, the period for writing the input signal voltage Vin ends. After the end of the writing period, when the sampling TFT 205 and the switching TFTs 208 and 209 are in the off-state, the drive signal DS1 output from the first drive scanning circuit 109 is switched to the "L" level, which turns off the switching TFT 206. Subsequently, the drive signal DS2 output from the second drive scanning circuit 110 is switched to the "H" level, which turns on the switching TFT 207.

The turning-on of the switching TFT 207 leads to a rise in the drain potential of the drive TFT 202 to the supply potential Vcc. Since the gate-source voltage Vgs of the drive TFT 202 is constant, the drive TFT 202 supplies the constant current Ids to the organic EL element 201. At this time, the potential at the connecting node N101 rises to a voltage Vx that permits the constant current Ids to flow through the organic EL element 201, which results in the light emission of the organic EL element 201.

Also in the pixel circuit 101 that executes the above-described series of operation, the I-V characteristic of the organic EL element 201 changes as the total emission period thereof becomes longer. Therefore, the potential at the connecting node N101 also changes.

However, since the gate-source voltage Vgs of the drive TFT 202 is kept at a constant value, the value of the current flowing through the organic EL element 201 does not change. Therefore, even when the I-V characteristic of the organic EL element 201 deteriorates, the constant current Ids invariably continues to flow, which causes no change in the emission luminance of the organic EL element 201. Furthermore, due to the operation of the switching TFT 208 in the threshold cancel period, the threshold voltage Vth of the drive TFT 202 can be cancelled, so that the constant current Ids that is not affected by variation in the threshold voltage Vth can be applied to the organic EL element 201, which allows achievement of high-quality images.

As described above, in the related art, each of the pixel circuits 101 is provided with a function to compensate variation in the I-V characteristic of the organic EL element 201 and a function to compensate variation in the threshold voltage Vth of the drive TFT 202. Thus, even when the I-V characteristic of the organic EL element 201 deteriorates with age and the threshold voltage Vth of the drive TFT 202 changes over time, the emission luminance of the organic EL element 201 can be kept constant without being affected by these changes.

However, the pixel circuit including N-channel TFTs involves variation in the carrier mobility μ of the drive TFT from pixel to pixel as well as the age deterioration of the I-V characteristic of the organic EL element and a change in the threshold voltage Vth of the drive TFT with time (variation from pixel to pixel). As is apparent from the aforementioned Equation (1), the difference in the mobility μ of the drive TFT among pixels causes variation in the current Ids flowing through the drive TFT from pixel to pixel, and therefore the emission luminance of the organic EL element varies from pixel to pixel, which results in a nonuniform image quality involving streaks and unevenness.

SUMMARY OF THE INVENTION

There is a need for an embodiment of the present invention to provide a display and a method for driving a display that both can realize, with a small number of components, a function to correct variation in the mobility of a drive TFT in addition to a function to compensate a change in the characteristic of an electro-optical element such as an organic EL element and a function to compensate a change (variation from pixel to pixel) in the threshold voltage Vth of the drive TFT for driving the electro-optical element so that a uniform image quality free from streaks and unevenness can be achieved.

According to one embodiment of the present invention, there is provided a display having the following configuration. Specifically, the display includes pixel circuits arranged in rows and columns. Each of the pixel circuits includes an electro-optical element (31) of which one end is connected to a first supply potential (GND in FIG. 3), a drive transistor (32) that has the source connected to the other end of the electro-optical element (31) and is formed of a thin film transistor, and a sampling transistor (33) that is connected between a data line and the gate of the drive transistor and captures an input signal dependent upon luminance information from the data line. Each of the pixel circuits further includes a first switching transistor (34) connected between the drain of the drive transistor and a second supply potential (Vcc), a second switching transistor (35) connected between the gate of the drive transistor and a third supply potential (Vofs), a third switching transistor (36) connected between the source of the drive transistor and a fourth supply potential (Vss), and a capacitor (37) connected between the gate and the source of the drive transistor.

A driver in the display initially executes first mobility correction operation for correcting variation in the mobility of the drive transistor by writing an intermediate grayscale level (gray level) to the gate of the drive transistor when the first switching transistor is in the conducting state.

Subsequently, the driver executes second mobility correction operation for correcting variation in the mobility of the drive transistor by writing the input signal (Vsig) to the gate of the drive transistor when the first switching transistor is in the conducting state.

That is, in the display in which the pixel circuits each including five transistors and one capacitor are arranged in rows and columns, mobility correction with an intermediate grayscale level is executed before mobility correction with an input signal level. This configuration and operation can change the time until the gate-source voltage of the drive transistor reaches the voltage that offers complete correction of the carrier mobility of the drive transistor (mobility-correction completion time, which differs for each grayscale). Specifically, for the white level, the time can be changed to be extended. For the black level, the time can be changed to be shortened.

According to embodiments of the invention, two-stage mobility correction is implemented: mobility correction with an intermediate grayscale level is executed in advance, followed by mobility correction with an input signal level. Thus, even if the mobility correction period is constant, mobility correction can be implemented for all the grayscales within the mobility correction period. This feature allows achievement of a uniform image quality free from streaks and unevenness attributed to variation in the mobility from pixel to pixel.

DETAILED DESCRIPTION OF THE PREFERRED EMBODIMENTS

Embodiments of the present invention will be described in detail below with reference to the accompanying drawings.

Initially, a pixel circuit according to the prior application that has been proposed by the present assignee in the specification of Japanese Patent Laid-open No. 2005-345722 will be described below as a reference example. This pixel circuit realizes, with a smaller number of components, a function to compensate a change in the characteristic of an organic EL element and a function to compensate a change (variation from pixel to pixel) in the threshold voltage Vth of a drive TFT.

REFERENCE EXAMPLE

Figure 3:
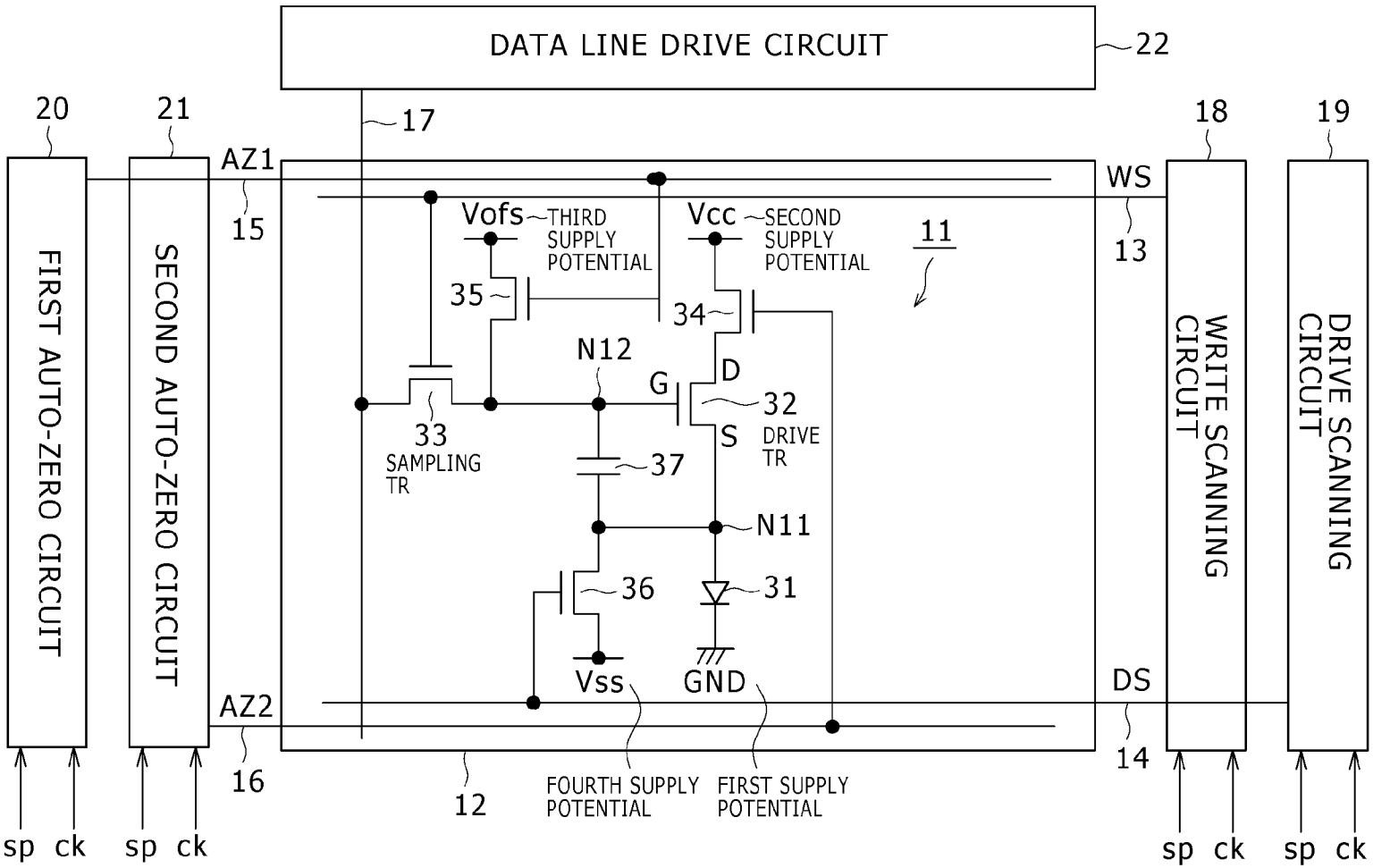
FIG. 3 is a circuit diagram showing the configurations of an active-matrix display and pixel circuits used in the display according to a reference example of the present invention.

FIG. 3 is a circuit diagram showing the configurations of an active-matrix display and pixel circuits used in the display according to the reference example. The active-matrix display of the reference example includes a pixel array 12 in which pixel circuits 11 each including an electro-optical element of which emission luminance varies depending on the current value, such as an organic EL element 31, are two-dimensionally arranged in rows and columns (in a matrix). FIG. 3 shows the specific circuit configuration of certain one pixel circuit 11 for simplified illustration.

In the pixel array 12, for the respective pixel circuits 11, scan lines 13, drive lines 14, and first and second auto-zero lines 15 and 16 are provided on each row basis, and data lines 17 are provided on each column basis. Arranged in the periphery of the pixel array 12 are a write scanning circuit 18 that drives the scan lines 13, a drive scanning circuit 19 that drives the drive lines 14, first and second auto-zero circuits 20 and 21 that drive the first and second auto-zero lines 15 and 16, respectively, and a data line drive circuit 22 that supplies the data lines 17 with data signals dependent upon luminance information.

In this example, the write scanning circuit 18 and the drive scanning circuit 19 are arranged on one side (e.g. the right side, in the drawing) of the pixel array 12, while the first and second auto-zero circuits 20 and 21 are arranged on the opposite side so that the pixel array 12 is sandwiched by these circuits. However, this arrangement relationship is merely one example, and the circuit configuration is not limited thereto. The write scanning circuit 18, the drive scanning circuit 19 and the first and second auto-zero circuits 20 and 21 start operation in response to a start pulse signal sp, and adequately output a write signal WS, a drive signal DS and first and second auto-zero signals AZ1 and AZ2, respectively, in sync with a clock pulse ck.

(Pixel Circuit)

Figure 1:
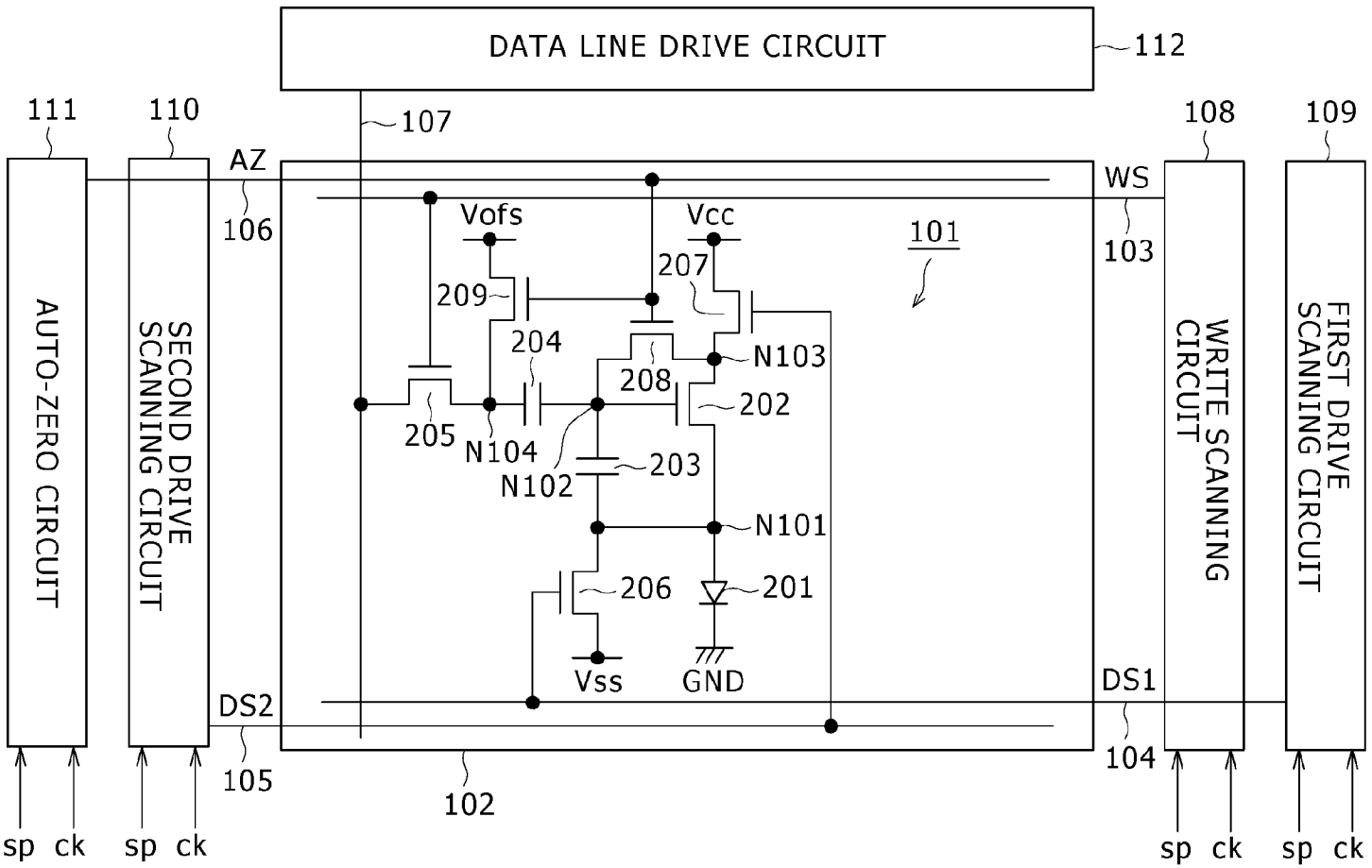
Related Art FIG. 1
FIG. 1 is a circuit diagram showing the configurations of an active-matrix display and pixel circuits used in the display according to a related art.
Figure 2:
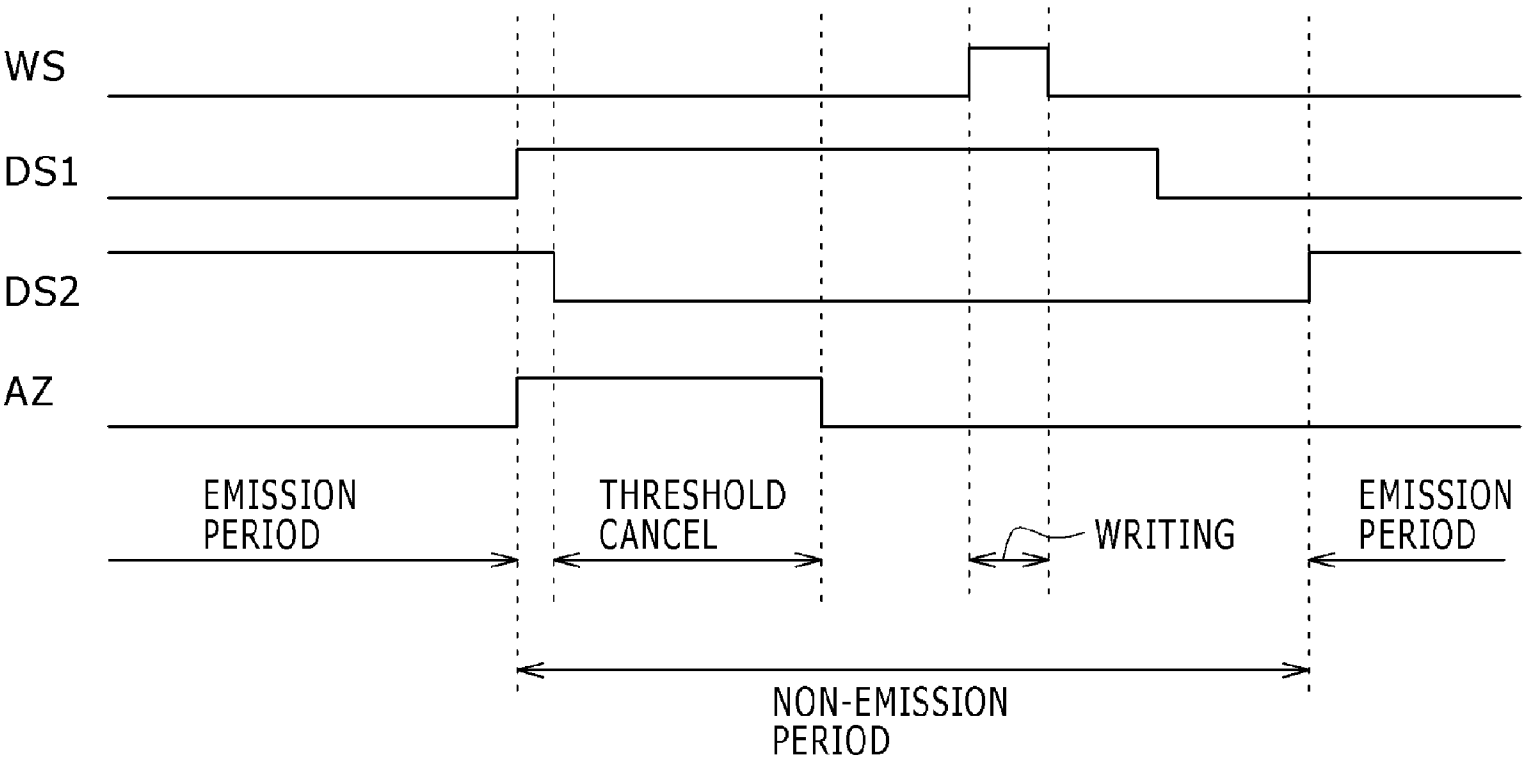
Related Art FIG. 2
FIG. 2 is a timing chart for explaining the circuit operation of the pixel circuit of the related art.

The pixel circuit 11 includes, in addition to the organic EL element 31, a drive transistor 32, a sampling transistor 33, switching transistors 34 to 36, and a capacitor (storage capacitor) 37 as components of the circuit. That is, the pixel circuit 11 of the reference example is formed of five transistors 32 to 36 and one capacitor 37. Therefore, each of the number of transistors and the number of capacitors in the pixel circuit 11 is smaller by one than that in the pixel circuit 101 of the related art in FIG. 1.

In this pixel circuit 11, e.g. N-channel TFTs are used as the drive transistor 32, the sampling transistor 33 and the switching transistors 34 to 36. Hereinafter, the drive transistor 32, the sampling transistor 33 and the switching transistors 34 to 36 are referred to as a drive TFT 32, a sampling TFT 33 and switching TFTs 34 to 36, respectively.

The cathode electrode of the organic EL element 31 is coupled to a first supply potential (ground potential GND, in this example). The drive TFT 32 is a drive transistor that current-drives the organic EL element 31, and the source thereof is connected to the anode electrode of the organic EL element 31, which leads to formation of a source follower circuit. The source of the sampling TFT 33 is connected to the data line 17, the drain thereof is connected to the gate of the drive TFT 32, and the gate thereof is connected to the scan line 13.

The drain of the switching TFT 34 is coupled to a second supply potential Vcc (positive supply potential, in this example), the source thereof is connected to the drain of the drive TFT 32, and the gate thereof is connected to the drive line 14. The drain of the switching TFT 35 is coupled to a third supply potential Vofs, the source thereof is connected to the drain of the sampling TFT 33 (gate of the drive TFT 32), and the gate thereof is connected to the first auto-zero line 15.

The drain of the switching TFT 36 is coupled to a connecting node N11 between the source of the drive TFT 32 and the anode electrode of the organic EL element 31, the source thereof is coupled to a fourth supply potential Vss (=GND, in this example), and the gate thereof is connected to the second auto-zero line 16. It is also possible to use a negative supply potential as the fourth supply potential Vss. One electrode of the capacitor 37 is coupled to a connecting node N12 between the gate of the drive TFT 32 and the drain of the sampling TFT 33, while the other electrode thereof is coupled to the connecting node N11 between the source of the drive TFT 32 and the anode electrode of the organic EL element 31.

In the pixel circuit 11 in which the respective components are connected to each other with the above-described connection relationship, the respective components operate as follows. Specifically, the sampling TFT 33 samples an input signal voltage Vsig supplied through the data line 17 when being turned to the on-(conducting) state. The sampled signal voltage Vsig is held by the capacitor 37. The switching TFT 34 supplies a current from the supply potential Vcc to the drive TFT 32 when being turned on.

The drive TFT 32 current-drives the organic EL element 31 depending on the signal voltage Vsig held by the capacitor 37. The switching TFTs 35 and 36 are adequately turned on so as to detect the threshold voltage Vth of the drive TFT 32 before the current-driving of the organic EL element 31 and store the detected threshold voltage Vth in the capacitor 37 in order to cancel the influence of the threshold voltage Vth in advance.

In the pixel circuit 11, as a condition for assuring normal operation, the fourth supply potential Vss is set lower than the potential obtained by subtracting the threshold voltage Vth of the drive TFT 32 from the third supply potential Vofs. That is, the level relationship Vss<Vofs−Vth is satisfied. In addition, the level arising from addition of the threshold voltage Vthel of the organic EL element 31 to the cathode voltage Vcat of the organic EL element 31 (ground potential GND, in this example) is set higher than the level obtained by subtracting the threshold voltage Vth of the drive TFT 32 from the supply potential Vofs. That is, the level relationship Vcat+Vthel>Vofs−Vth is satisfied.

Figure 4:
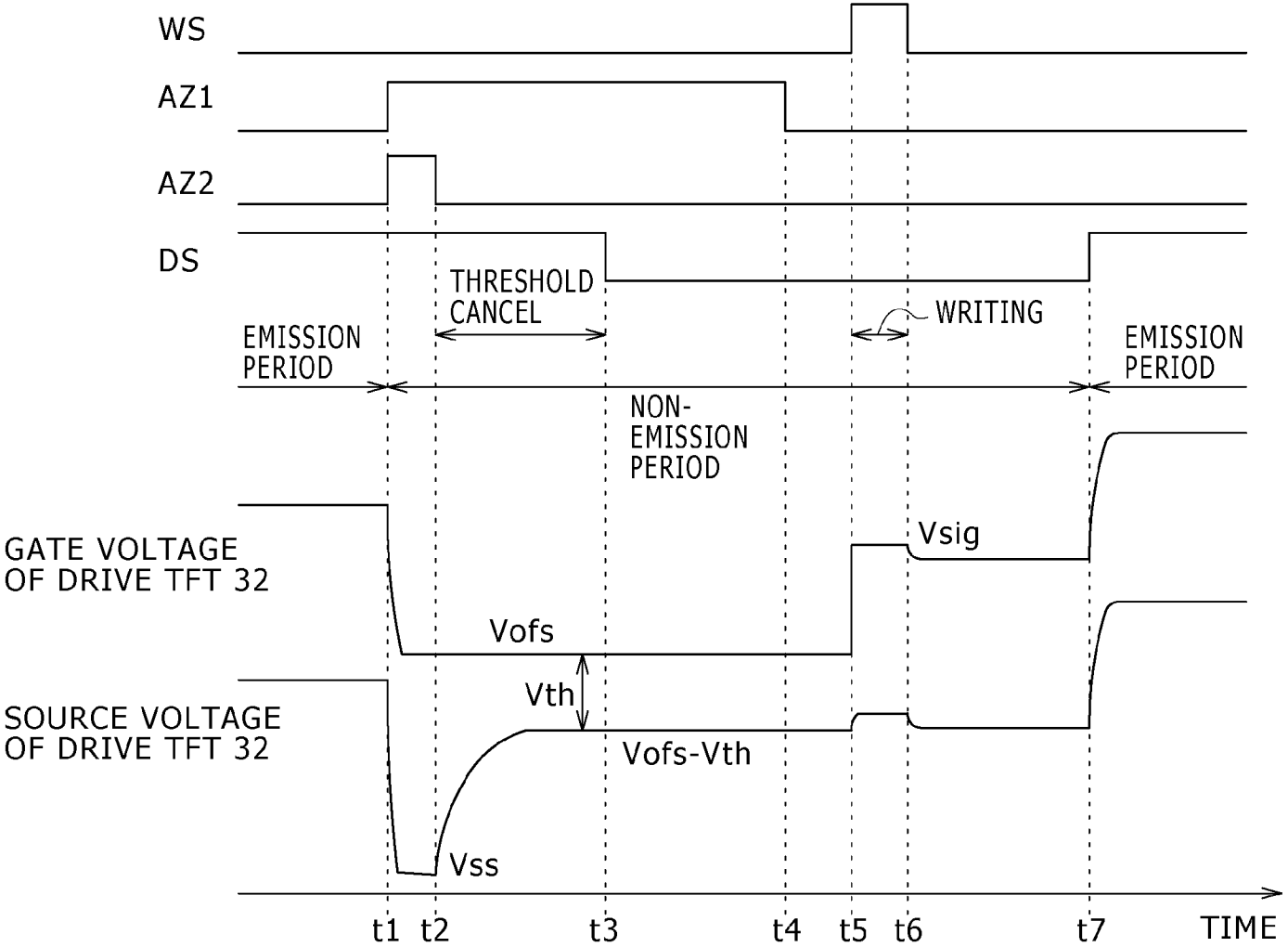
FIG. 4 is a timing chart for explaining the circuit operation of the pixel circuit of the reference example.

In the following, a description will be made on the circuit operation of an active-matrix organic EL display in which the pixel circuits 11 each having the above-described configuration are two-dimensionally arranged in a matrix with reference to the timing chart of FIG. 4 and the explanatory operation diagrams of FIGS. 5 to 10.

When the pixel circuit 11 on a certain row is driven, the write signal WS is supplied to the pixel circuit 11 from the write scanning circuit 18 via the scan line 13, and the drive signal DS is supplied to the pixel circuit 11 from the drive scanning circuit 19 via the drive line 14. Furthermore, the first and second auto-zero signals AZ1 and AZ2 are supplied to the pixel circuit 11 from the first and second auto-zero circuits 20 and 21 via the first and second auto-zero lines 15 and 16, respectively. FIG. 4 shows the timing relationship among these signals and changes in the gate voltage and source voltage of the drive TFT 32 in association with the timing relationship.

The "H" level state of the write signal WS, the drive signal DS and the first and second auto-zero signals AZ1 and AZ2 is defined as the active state thereof, while the "L" level state is defined as the inactive state. In the explanatory operation diagrams of FIGS. 5 to 10, the sampling TFT 33 and the switching TFTs 34 to 36 are represented by use of the symbol for a switch for simplified illustration.

(Emission Period)

Figure 5:
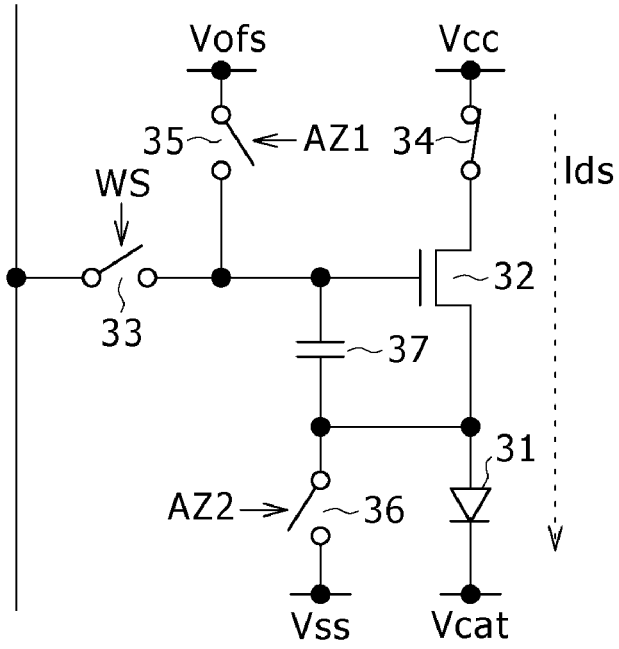
FIG. 5 is a first explanatory diagram for the operation of the pixel circuit of the reference example.

In a normal emission state, the write signal WS output from the write scanning circuit 18, and the first and second auto-zero signals AZ1 and AZ2 output from the first and second auto-zero circuits 20 and 21 are at the "L" level, while the drive signal DS output from the drive scanning circuit 19 is at the "H" level. Therefore, as shown in FIG. 5, the sampling TFT 33 and the switching TFTs 35 and 36 are in the off-state, while the switching TFT 34 is in the on-state. At this time, the drive TFT 32 operates as a constant current source since it is designed so as to operate in the saturation region. As a result, the constant current Ids expressed by the aforementioned Equation (1) is supplied from the drive TFT 32 via the switching TFT 34 via the drive TFT 32 to the organic EL element 31.

(Non-Emission Period)

Figure 6:
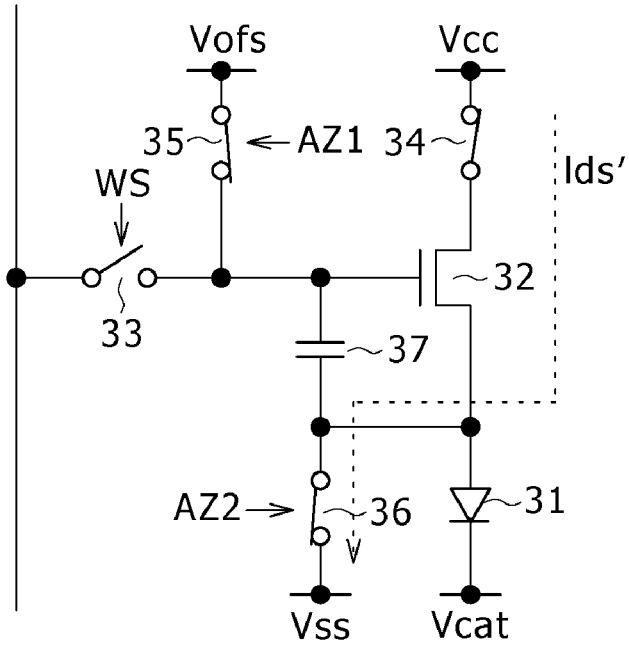
FIG. 6 is a second explanatory diagram for the operation of the pixel circuit of the reference example.

When the switching TFT 34 is in the on-state, both the first and second auto-zero signals AZ1 and AZ2 output from the first and second auto-zero circuits 20 and 21 are switched to the "H" level at time t1, which turns on the switching TFTs 35 and 36 as shown in FIG. 6. There is no limitation on the order of the turning-on of the switching TFTs 35 and 36. Due to the switching-on of the TFTs 35 and 36, the predetermined potential Vofs is applied to the gate of the drive TFT 32 via the switching TFT 35, and the supply potential Vss is applied to the anode electrode of the organic EL element 31 via the switching TFT 36.

At this time, the organic EL element 31 is reverse biased since the relationship Vss<Vcat+Vthel is satisfied as described above. Therefore, a current does not flow through the organic EL element 31, and hence the organic EL element 31 is in the non-emission state. Furthermore, the gate-source voltage Vgs of the drive TFT 32 takes a value of Vofs−Vss. Thus, a current Ids' corresponding to this value of Vofs−Vss flows through the path indicated by the doted line in FIG. 6, i.e., the path of Vcc→switching TFT 34→drive TFT 32→node N11 →switching TFT 36→Vss.

(Threshold Cancel Period)

Figure 7:
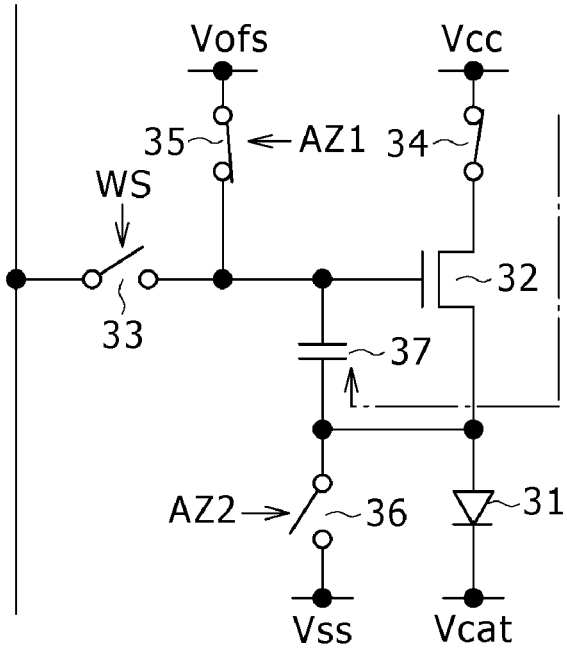
FIG. 7 is a third explanatory diagram for the operation of the pixel circuit of the reference example.
Figure 8:
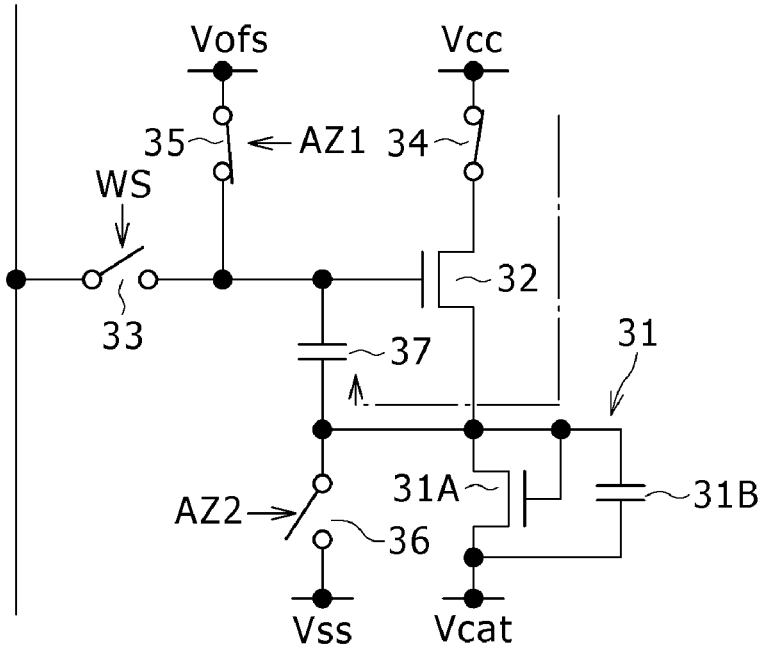
FIG. 8 is a fourth explanatory diagram for the operation of the pixel circuit of the reference example.

At time t2, the auto-zero signal AZ2 output from the second auto-zero circuit 21 is turned to the "L" level. Thus, as shown in FIG. 7, the switching TFT 36 becomes the off-state and thus the operation time sequence enters a threshold cancel period for canceling (correcting) the threshold voltage Vth of the drive TFT 32.

The turning-off of the switching TFT 36 blocks the path of the current Ids flowing through the drive TFT 32. The organic EL element 31 can be expressed by a diode 31A and a capacitor 31B as indicated by an equivalent circuit in FIG. 8. As long as the voltage Vel applied to the organic EL element 31 satisfies the relationship Vel<Vcat+Vthel (the leakage current of the organic EL element 31 is considerably smaller than the current flowing through the drive TFT 32) as described above, the current flowing through the drive TFT 32 charges the capacitors 37 and 31B.

Figure 11:
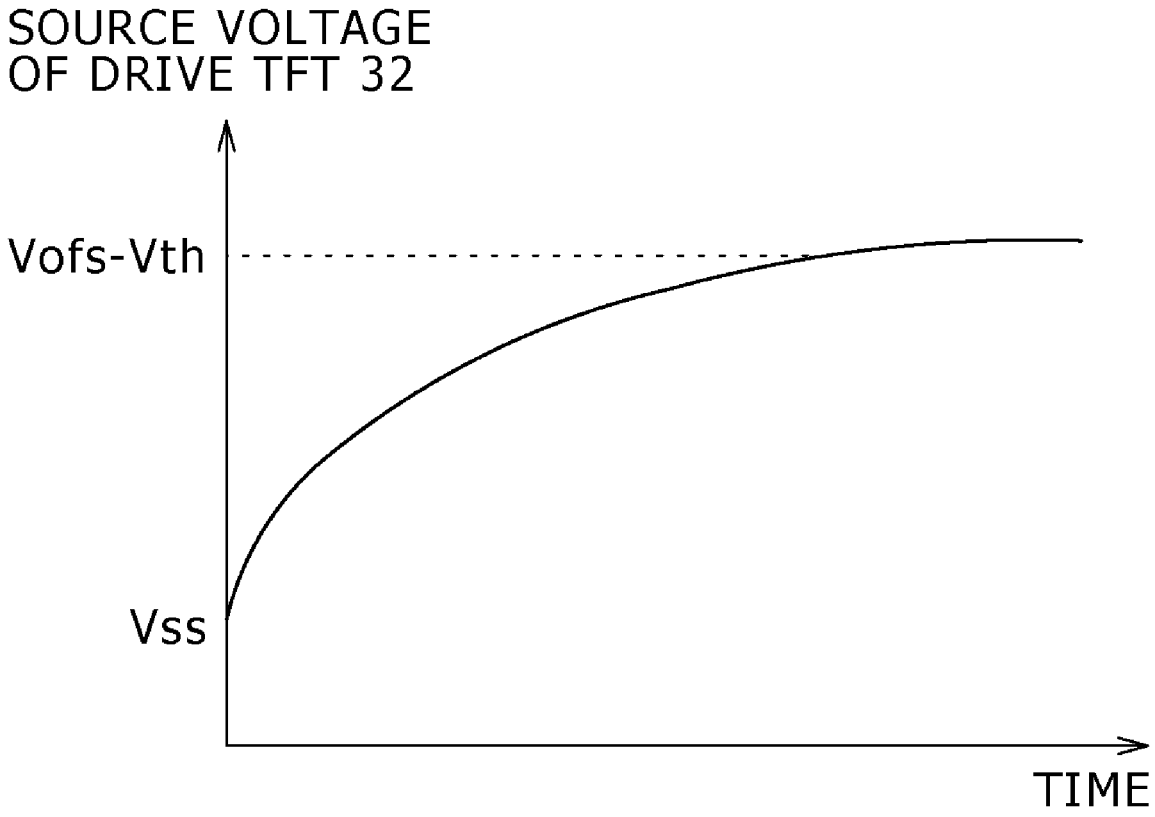
FIG. 11 is a characteristic diagram for explaining the operation of the pixel circuit of the reference example.

During this charging, the potential at the node N11, i.e., the source voltage Vel of the drive TFT 32, gradually rises as the time passes as shown in FIG. 11. After elapse of a certain period, when the potential difference between the nodes N11 and N12, i.e., the gate-source voltage Vgs of the drive TFT 32, becomes just the threshold voltage Vth, the drive TFT 32 is switched from the on-state to the off-state. This potential difference Vth between the nodes N11 and N12 is stored in the capacitor 37 as the potential for canceling (correcting) the threshold. At this time, the relationship Vel=Vofs−Vth<Vcat+Vthel is satisfied.

Thereafter, when the switching TFTs 34 and 35 are in the on-state and the switching TFT 36 is in the off-state, the drive signal DS output from the drive scanning circuit 19 and the auto-zero signal AZ1 output from the first auto-zero circuit 20 are sequentially switched from the "H" level to the "L" level at time t3 and time t4, respectively. Thus, the switching TFTs 34 and 35 are sequentially turned off, which ends the threshold cancel period. The turning-off of the switching TFT 34 before that of the switching TFT 35 can suppress a change in the gate voltage of the drive TFT 32.

(Writing Period)

Figure 9:
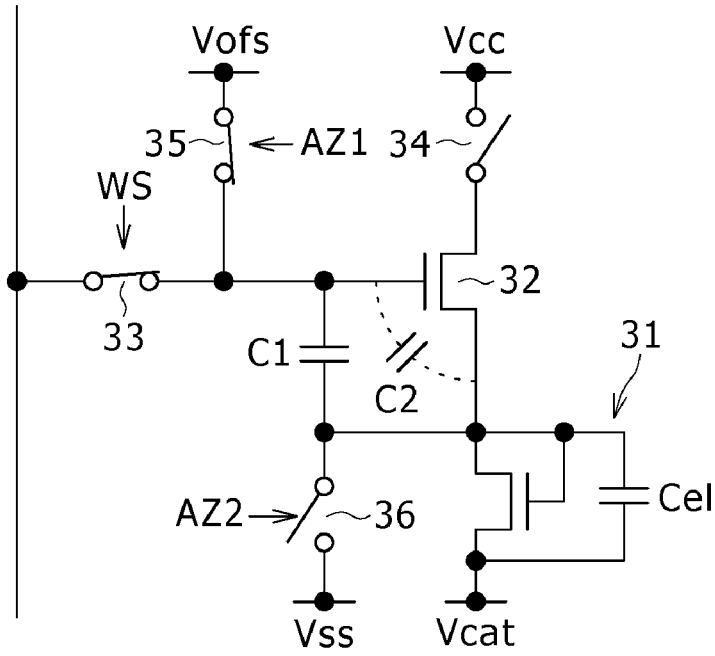
FIG. 9 is a fifth explanatory diagram for the operation of the pixel circuit of the reference example.

Subsequently, when the switching TFTs 34, 35 and 36 are in the off-state, the write signal WS output from the write scanning circuit 18 is turned to the "H" level at time t5. Thus, as shown in FIG. 9, the sampling TFT 33 enters the on-state, which starts a period for writing the input signal voltage Vsig. In this writing period, the input signal voltage Vsig is sampled through the sampling TFT 33 so as to be written to the capacitor 37.

At this time, the signal voltage Vsig is stored in such a manner as to be added to the threshold voltage Vth held by the capacitor 37. As a result, variation in the threshold voltage Vth of the drive TFT 32 is invariably cancelled. That is, storing the threshold voltage Vth in the capacitor 37 in advance allows cancel (correction) of variation in the threshold voltage Vth, i.e., threshold cancel.

When the capacitance of the capacitor 37 is defined as C1, the capacitance of the capacitor 31B in the organic EL element 31 is defined as Cel, and the parasitic capacitance of the drive TFT 32 is defined as C2, the gate-source voltage Vgs of the drive TFT 32 is expressed by Equation (3).

$$Vgs=\{Cel/(Cel+C1+C2)\}\cdot(Vsig-Vofs)+Vth \quad (3)$$

In general, the capacitance Cel of the capacitor 31B in the organic EL element 31 is larger than the capacitance C1 of the capacitor 37 and the parasitic capacitance C2 of the drive TFT 32. Therefore, the gate-source voltage Vgs of the drive TFT 32 is approximately Vsig+Vth.

When the write signal WS output from the write scanning circuit 18 is changed from the "H" level to the "L" level at time t6 and hence the sampling TFT 33 is turned off, the period for writing the input signal voltage Vsig ends.

(Emission Period)

Figure 10:
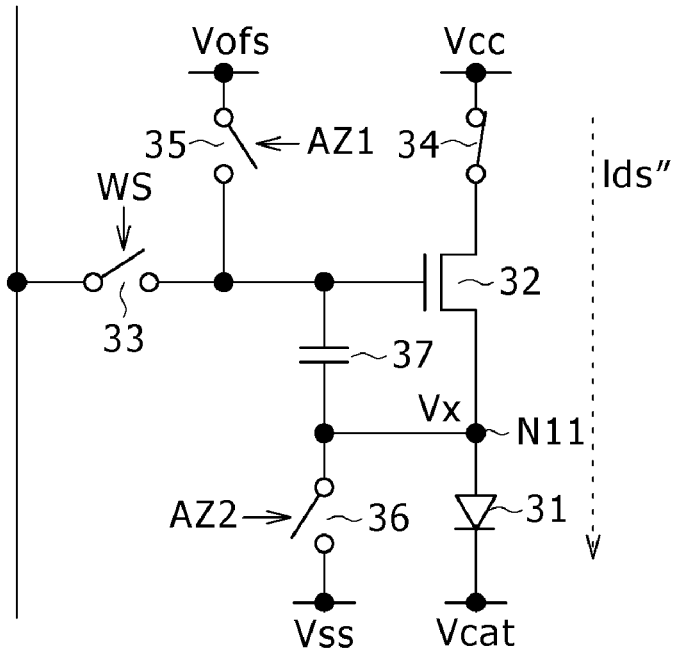
FIG. 10 is a sixth explanatory diagram for the operation of the pixel circuit of the reference example.

After the end of the writing period, when the sampling TFT 33 and the switching TFTs 35 and 36 are in the off-state, the drive signal DS output from the drive scanning circuit 19 is turned to the "H" level at time t7. Thus, as shown in FIG. 10, the switching TFT 34 enters the on-state, which starts an emission period.

The turning-on of the switching TFT 34 leads to a rise in the drain voltage of the drive TFT 32 to the supply potential Vcc. Since the gate-source voltage Vgs of the drive TFT 32 is constant, the drive TFT 32 supplies the constant current Ids" to the organic EL element 31. At this time, the anode voltage Vel of the organic EL element 31 rises to a voltage Vx that allows the constant current Ids" to flow through the organic EL element 31. As a result, the organic EL element 31 starts light emission operation.

The flowing of a current through the organic EL element 31 causes a voltage drop in the organic EL element 31, which raises the potential at the node N11. In association with this potential rise, the potential at the node N12 also rises. Therefore, the gate-source voltage Vgs of the drive TFT 32 is invariably kept at Vsig+Vth despite the potential rise at the node N11. As a result, the organic EL element 31 continues to emit light with the luminance dependent upon the input signal voltage Vsig.

Also in the pixel circuit 11 of the above-described reference example, the I-V characteristic of the organic EL element 31 changes as the total emission period thereof becomes longer. Accordingly, the potential at the connecting node N11 between the anode electrode of the organic EL element 31 and the source of the drive TFT 32 also changes. However, since the gate-source voltage Vgs of the drive TFT 32 is kept at a constant value, the current flowing through the organic EL element 31 does not change. Therefore, even when the I-V characteristic of the organic EL element 31 deteriorates, the constant current Ids invariably continues to flow, which causes no change in the emission luminance of the organic EL element 31 (function to compensate variation in the characteristic of the organic EL element 31).

Furthermore, the threshold voltage Vth of the drive TFT 32 is stored in the capacitor 37 in advance before writing of the input signal voltage Vsig. Thus, due to the operation of the switching TFTs 34 to 36 and the capacitor 37 in the threshold cancel period, the threshold voltage Vth of the drive TFT 32 can be cancelled, so that the constant current Ids that is not affected by variation in the threshold voltage Vth can be invariably applied to the organic EL element 31, which allows achievement of high-quality images (function to compensate variation in the threshold voltage Vth of the drive TFT 32).

However, as described above, the pixel circuit 11 including N-channel TFTs involves variation in the carrier mobility μ of the drive TFT 32 from pixel to pixel as well as the age deterioration of the I-V characteristic of the organic EL element 31 and a change in the threshold voltage Vth of the drive TFT 32 with time (variation from pixel to pixel). The difference in the mobility μ of the drive TFT among pixels causes variation in the current Ids flowing through the drive TFT from pixel to pixel, and therefore the emission luminance of the organic EL element varies from pixel to pixel, which contributes to the occurrence of streaks and unevenness.

To address this problem, embodiments of the present invention are configured so that correction of variation in the mobility μ of the drive TFT 32 (hereinafter, referred to as mobility correction) is implemented to thereby obtain a uniform image quality free from streaks and unevenness in an active-matrix organic EL display including the pixel circuits 11 that are two-dimensionally arranged in a matrix and each realize, with a smaller number of components (five transistors 32 to 36 and one capacitor 37), a function to compensate variation in the characteristic of the organic EL element 31 and a function to compensate variation in the threshold voltage Vth of the drive TFT 32.

Specific three of the embodiments will be described below. Note that in each of the embodiments, the configurations of the pixel circuit 11 and the active-matrix organic EL display in which the pixel circuits 11 are two-dimensionally arranged in a matrix are basically the same as those of the above-described reference example.

First Embodiment

Figure 12:
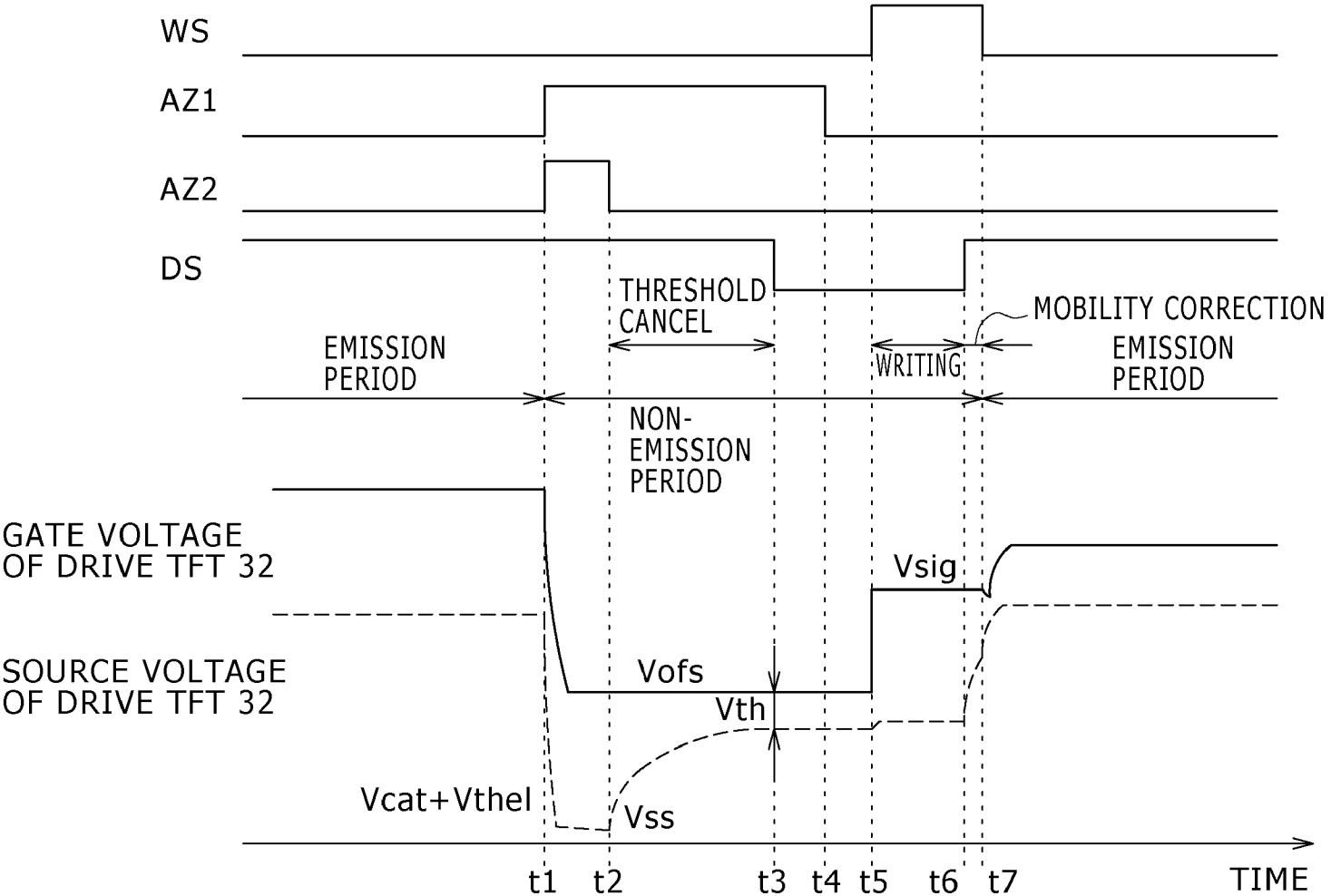
FIG. 12 is a timing chart showing drive timing according to a first embodiment of the invention.

FIG. 12 is a timing chart showing the drive timing according to a first embodiment of the invention. The drive timing of the first embodiment is different from that of the above-described reference example in that in a non-emission period of the organic EL element 31 of the first embodiment, the active period during which the write signal WS output from the write scanning circuit 18 is at the "H" level is overlapped with the active period during which the drive signal DS output from the drive scanning circuit 19 is at the "H" level, and the overlapping period is defined as a mobility correction period. Other features are basically the same.

The operation before time t5 in the timing chart of FIG. 12 is the same as that in the reference example. Therefore, in the following, a description will be made on the operation at the time t5 and later, and particularly on the operation in the mobility correction period, i.e., the operation during the period from time t6 to time t7.

(Mobility Correction Period)

The write signal WS is turned to the "H" level at the time t5, and thus a writing period starts. Subsequently, the drive signal DS is turned to the "H" level at the time t6, which starts the mobility correction period. At this time, if the source voltage of the drive TFT 32 is lower than the sum between the threshold voltage Vthel and the cathode voltage Vcat of the organic EL element 31, i.e., the leakage current of the organic EL element 31 is considerably smaller than the current flowing through the drive TFT 32, the current flowing through the drive TFT 32 charges the capacitors 37 and 31B.

Figure 13:
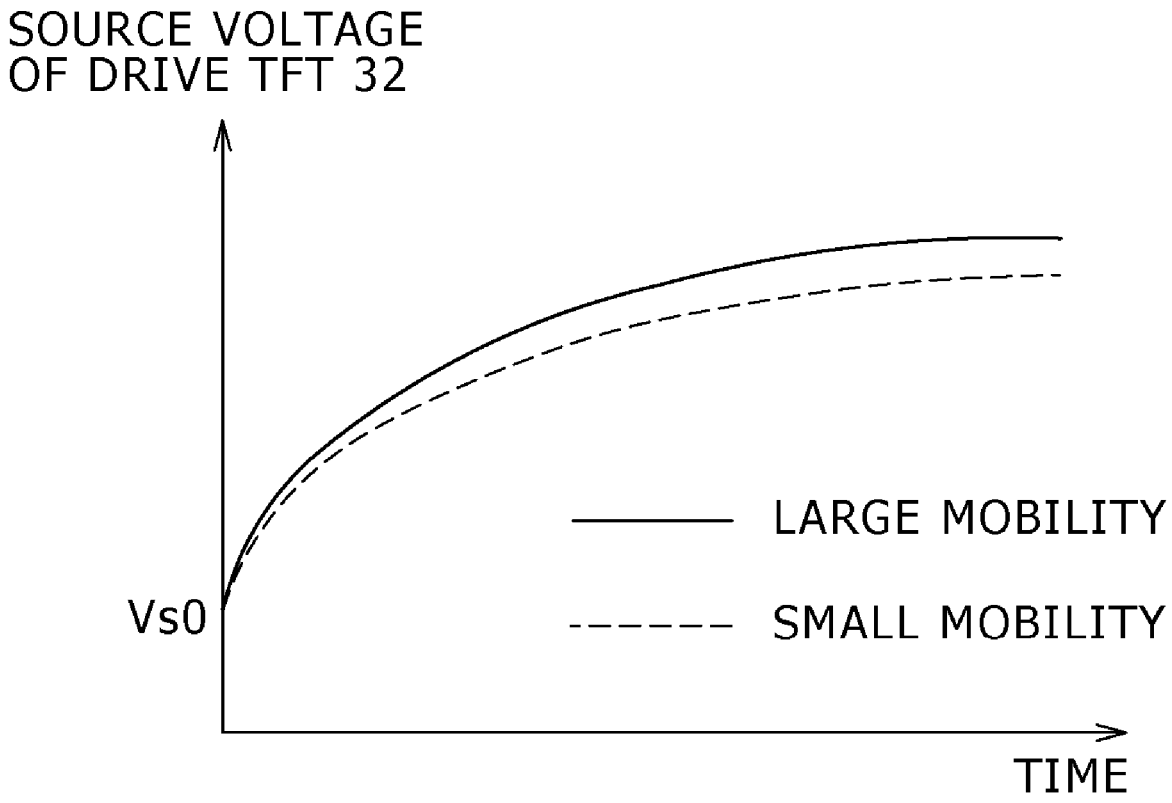
FIG. 13 is a diagram showing the relationship between the mobility and source voltage of a drive TFT.

During this charging, the current flowing through the drive TFT 32 reflects the carrier mobility μ of the drive TFT 32 since threshold cancel (threshold correction) operation has been already completed as described above. Specifically, as shown in FIG. 13, a large mobility μ of the drive TFT 32 offers a large current amount, and hence leads to a fast rise in the source voltage. In contrast, a small mobility μ of the drive TFT 32 offers a small current amount, and hence leads to a slow rise in the source voltage. Thus, the gate-source voltage Vgs of the drive TFT 32 decreases in such a manner as to reflect the mobility μ, and becomes a voltage value Vgs' that offers complete correction of the mobility μ, after a certain period has elapsed (mobility correction function).

In FIG. 13, the initial source voltage Vs0 of the drive TFT 32 is expressed by Equation (4).

$$Vs0=Vofs-Vth+\{C1+C2\}/(C1+C2+Cel)\}\cdot(Vsig-Vofs) \quad (4)$$

(Emission Period)

At the time t7, the write signal WS is changed from the "H" level to the "L" level, which turns off the sampling TFT 33. Thus, the writing period for the input signal voltage Vsig and the mobility correction period finish, and simultaneously an emission period starts since the switching TFT 34 is kept in the on-state. At this time, since the gate-source voltage Vgs of the drive TFT 32 is constant, the drive TFT 32 supplies the constant current Ids" to the organic EL element 31. As a result, the organic EL element 31 starts light emission operation.

A discussion will be made below on the mobility correction operation. The current value of the drive TFT 32 at the start of the mobility correction period is larger in a pixel with a white level (largest grayscale level) than in one with a black level (smallest grayscale level). The time period t until the gate-source voltage Vgs of the drive TFT 32 reaches the voltage Vgs' that offers complete correction of the mobility μ (hereinafter, referred to as mobility-correction completion time t) is expressed by Equation (5). According to Equation (5), the mobility-correction completion time t is shorter for white than for black.

$$t=1/V\cdot C/\{n\cdot 1/2-Cox\cdot W/L\cdot\sqrt{(\mu 1\cdot\mu 2)}\} \quad (5)$$

In Equation (5), V is the voltage Vgs−Vth at the beginning of the mobility correction for the respective grayscales, and C is the entire capacitance from a viewpoint of the source of the drive TFT 32 during the mobility correction period (C1+C2+Cel, in the first embodiment). Furthermore, n is the dynamic characteristic coefficient during the mobility correction period, and μ is the carrier mobility of the drive TFT 32 (μ1: small mobility, μ2: large mobility).

If the mobility-correction completion time t differs depending on the grayscale in this manner, it is impossible to correct the mobility for all the grayscales within a constant mobility correction period (t6 to t7). As a result, there is a fear that streaks and unevenness attributed to the mobility variation are recognized at the grayscales for which the mobility correction cannot be carried out.

To address this problem, in the organic EL display according to the present embodiment, the mobility correction is implemented in two stages in the mobility correction period, during which both the sampling TFT 33 and the switching TFT 34 are in the on-(conducting) state. Specifically, initially an intermediate grayscale level (e.g., gray level) is written to the pixel circuit 11 from the data line drive circuit 22 via the data line 17, so that the mobility correction is carried out with this intermediate grayscale in advance. Subsequently, a desired signal voltage Vsig is written to the pixel circuit 11 from the data line drive circuit 22 via the data line 17, so that the mobility correction is carried out again.

This two-stage mobility correction operation is executed under control by the write scanning circuit 18 that drives the sampling TFT 33 to be turned on/off and the drive scanning circuit 19 that drives the switching TFT 34 to be turned on/off. Therefore, in the organic EL display of the present embodiment, the write scanning circuit 18 and the drive scanning circuit 19 correspond to the driver set forth in the claims.

This mobility correction with an intermediate grayscale before the mobility correction with a desired signal voltage Vsig can change the mobility-correction completion time t, which originally differs for each grayscale. Specifically, for the white level, the time t can be changed to be extended. In contrast, for the black level, the time t can be changed to be shortened. Thus, even when the mobility correction period is constant, the mobility μ can be corrected for all the grayscales within the mobility correction period, which allows achievement of a uniform image quality free from streaks and unevenness attributed to variation in the mobility from pixel to pixel.

A more specific description will be made below on the mobility correction for the white level and that for the black level as an example.

Figure 14A:
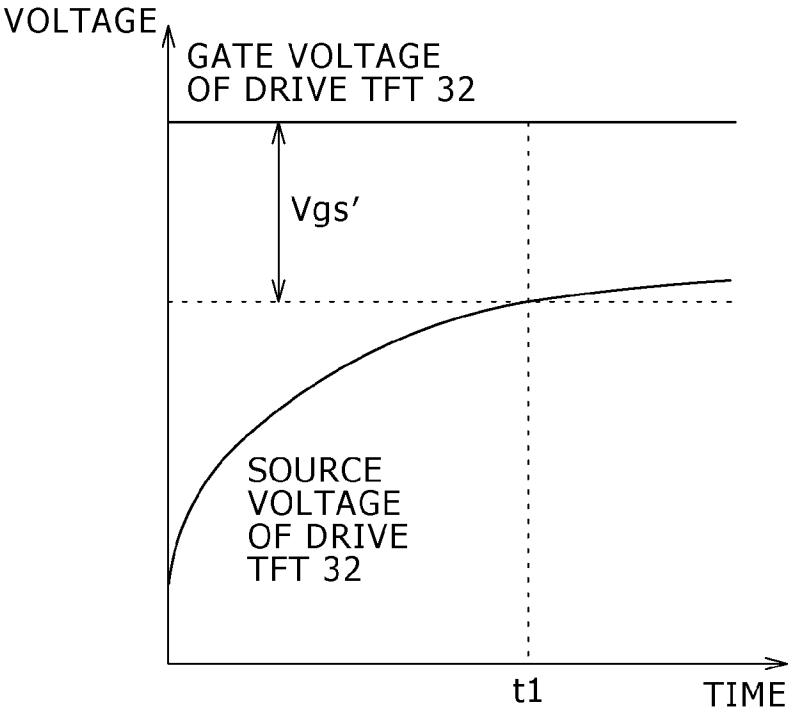
FIGS. 14A and 14B are diagrams showing changes in the gate voltage and source voltage of a drive TFT for the white level when correction with an intermediate grayscale is not implemented and when it is implemented, respectively.

At the white level, the current value of the drive TFT 32 at the start of the mobility correction period is the largest in the grayscale level range, and hence the voltage V at the beginning of the mobility correction is also the highest. Therefore, the mobility-correction completion time is the shortest as is apparent from Equation (5). The mobility-correction completion time for the white level is defined as t1. If mobility correction is carried out with the white level from the beginning of the mobility correction period, the source voltage of the drive TFT 32 rises with the curve indicated in FIG. 14A, so that the gate-source voltage of the drive TFT 32 reaches the voltage Vgs' that offers complete correction of the mobility μ after elapse of the time t1.

Figure 14B:
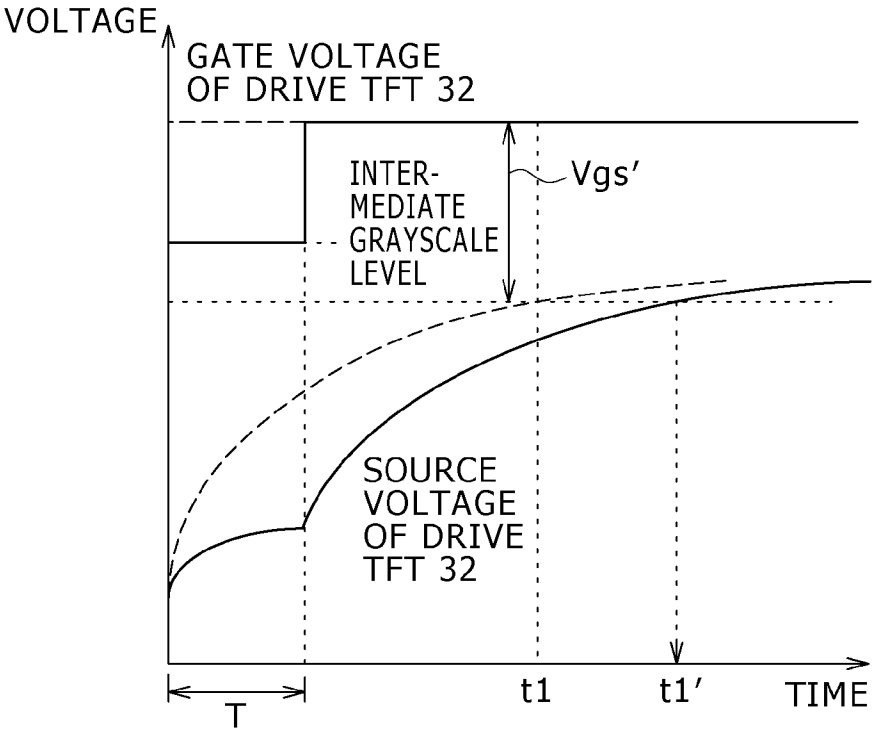

In contrast, if mobility correction is implemented with an intermediate grayscale before the mobility correction with the white level, and then mobility correction is implemented again with the white level, the source voltage of the drive TFT 32 changes as indicated by the full line in FIG. 14B, unlike the voltage change when mobility correction is carried out with the white level from the beginning (doted line). Specifically, in the period of the correction with the intermediate grayscale, the source voltage rises with a curve that is gentler than that indicated by the doted line. Subsequently, in the period of the correction with the white level, the source voltage rises to trace a curve similar to the original curve indicated by the doted line.

Thus, it is not until a period longer than the period when mobility correction is implemented with the white level from the beginning has passed that the gate-source voltage of the drive TFT 32 reaches the voltage Vgs' that offers complete correction of the mobility μ. In other words, by implementing mobility correction with the intermediate grayscale before the mobility correction with the white level, the mobility-correction completion time t1, which is the shortest in the grayscale level range, can be changed to longer time t1'.

Figure 15A:
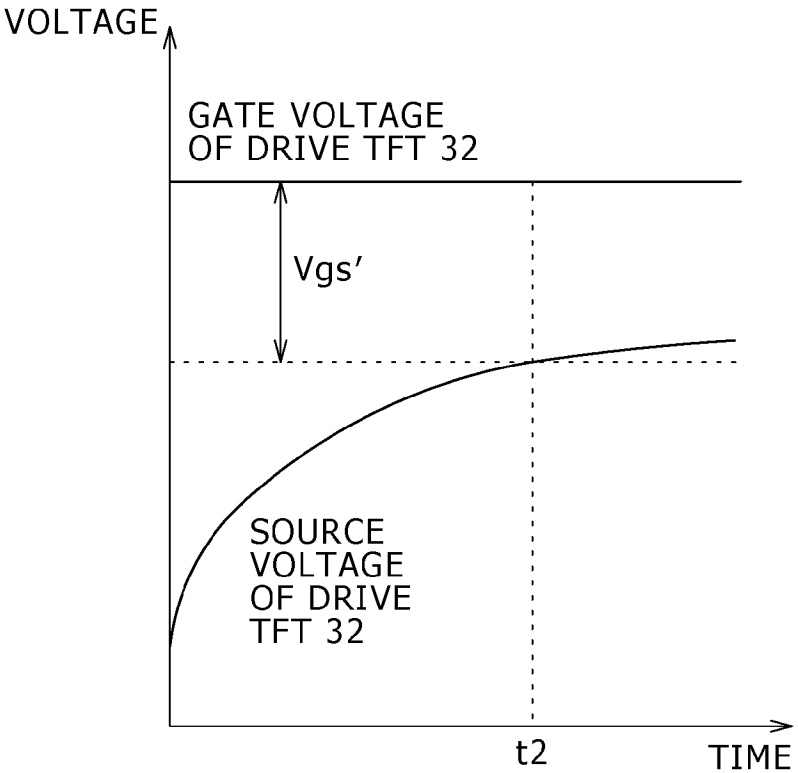
FIGS. 15A and 15B are diagrams showing changes in the gate voltage and source voltage of a drive TFT for the black level when correction with an intermediate grayscale is not implemented and when it is implemented, respectively.

A discussion will be made below on the black level. In contrast to the white level, at the black level, the current value of the drive TFT 32 at the start of the mobility correction period is the smallest in the grayscale level range, and hence the voltage V at the beginning of the mobility correction is also the lowest. Therefore, the mobility-correction completion time is the longest as is apparent from Equation (5). The mobility-correction completion time for the black level is defined as t2. If mobility correction is carried out with the black level from the beginning of the mobility correction period, the source voltage of the drive TFT 32 rises with the curve indicated in FIG. 15A, so that the gate-source voltage of the drive TFT 32 reaches the voltage Vgs' that offers complete correction of the mobility μ after elapse of the time t2.

Figure 15B:
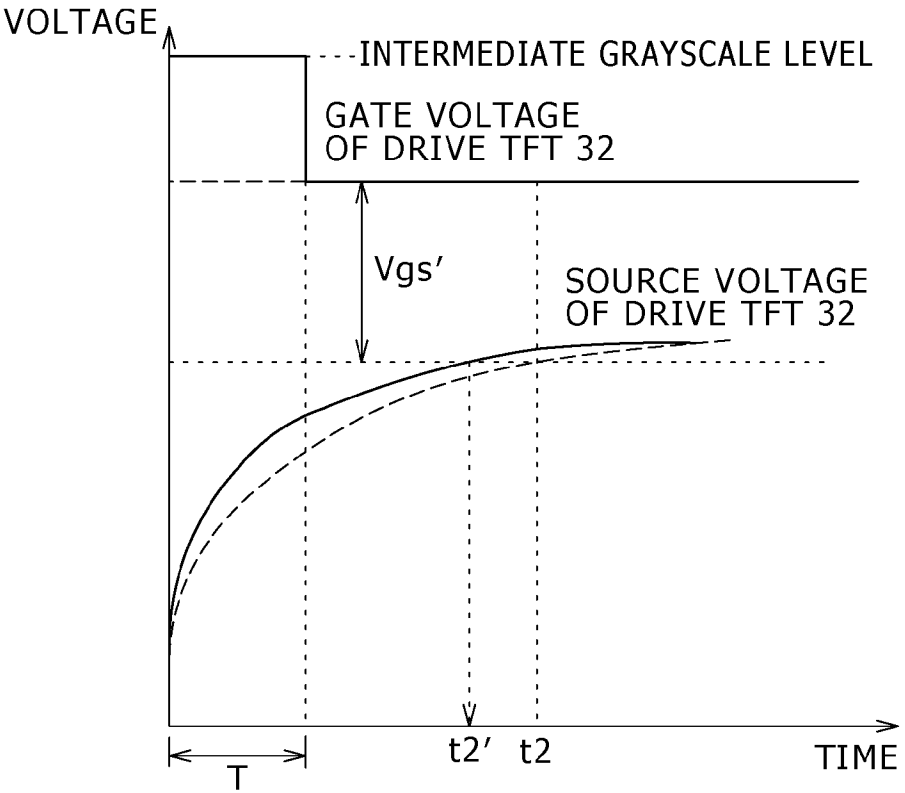

In contrast, if mobility correction is implemented with an intermediate grayscale before the mobility correction with the black level, and then mobility correction is implemented again with the black level, the source voltage of the drive TFT 32 changes as indicated by the full line in FIG. 15B, unlike the voltage change when mobility correction is carried out with the black level from the beginning (doted line). Specifically, in the period of the correction with the intermediate grayscale, the source voltage rises with a curve that is steeper than that indicated by the doted line. Subsequently, in the period of the correction with the black level, the source voltage rises with a curve similar to the original curve indicated by the doted line.

Thus, the gate-source voltage of the drive TFT 32 can reach the voltage Vgs' that offers complete correction of the mobility μ in a period shorter than the period when mobility correction is implemented with the black level from the beginning. In other words, by implementing mobility correction with the intermediate grayscale before the mobility correction with the black level, the mobility-correction completion time t2, which is the longest in the grayscale level range, can be changed to shorter time t2'.

In the above description, an explanation has been made about the white and black levels, which are the largest and smallest grayscale levels, respectively, in the grayscale level range. However, similar theories to those for the white and black levels apply also to other grayscale levels.

As described above, in the first embodiment, in an active-matrix organic EL display that realizes a function to compensate variation in the characteristic of the organic EL element 31 and a function to compensate variation in the threshold voltage Vth of the drive TFT 32 with a smaller number of components, specifically with five transistors 32 to 36 and one capacitor 37, mobility correction is implemented with an intermediate grayscale before mobility correction with a desired signal voltage Vsig in correction of the mobility of the drive TFT 32. Thus, the mobility-correction completion time t, which is different from grayscale to grayscale, can be changed.

Specifically, although originally the periods until the correction of the mobility μ has been completed for the white and black levels are the time t1 and the time t2, respectively, the preliminary correction with an intermediate grayscale can change the time t1 for the white level to the longer time t1' and change the time t2 for the black level to the shorter time t2'. Thus, variation in the mobility μ from pixel to pixel can be corrected for all the grayscales within a constant mobility correction period, which allows achievement of a uniform image quality free from streaks and unevenness attributed to the variation in the mobility μ from pixel to pixel.

Furthermore, by controlling the period of the mobility correction with an intermediate grayscale, i.e., the time period T in FIGS. 14B and 15B, the time width between the original time t1 (t2) and the changed time t1' (t2') can be adjusted. This time width adjustment allows more favorable mobility correction, which results in achievement of a more uniform image quality free from streaks and unevenness.

In the present embodiment, an intermediate grayscale level is supplied from the data line drive circuit 22 to the data line 17. Alternatively, another configuration is also available in which a precharge switch is connected to the data line 17 and an intermediate grayscale level is selectively supplied to the data line 17 via the precharge switch.

In general, in a display in which each transistor in the pixel circuit 11 is formed of a TFT fabricated through a low-temperature poly-silicon process, a multiple writing system, such as three-time writing system, is employed. In this system, a signal voltage Vsig is written to each pixel on one row (one line) plural times within one horizontal period.

Figure 16:
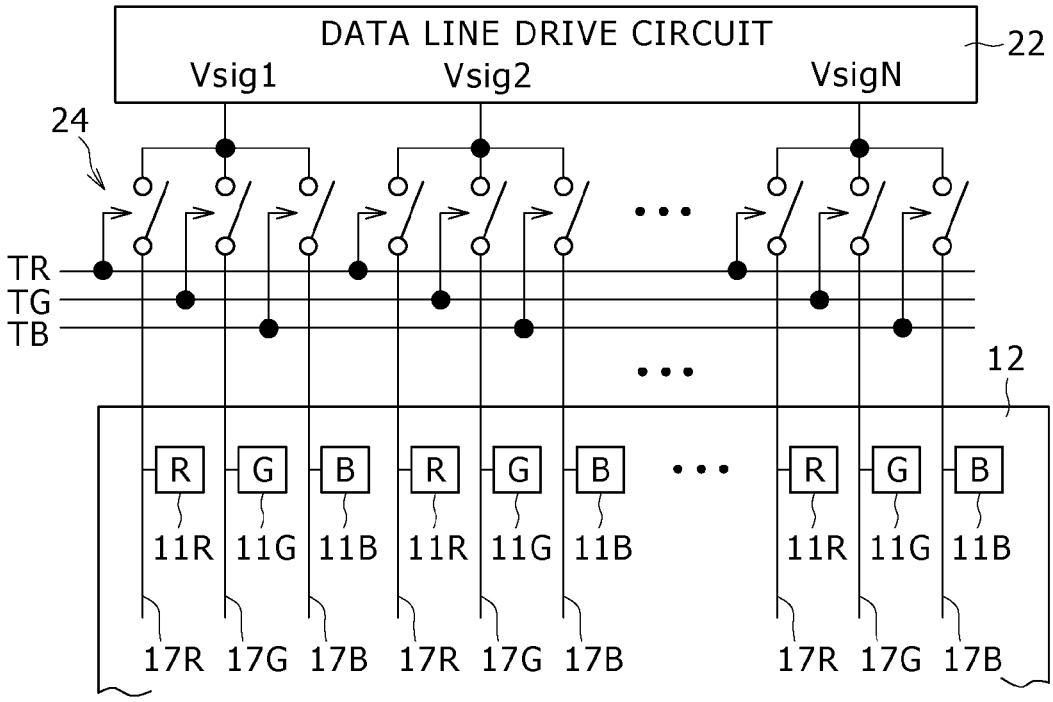
FIG. 16 is a circuit diagram showing a configuration example of major part of a display that employs a three-time writing system.

In e.g. a color display in which three pixel circuits neighboring each other in the horizontal direction correspond to R (red), G (green) and B (blue), respectively, and these three pixel circuits are defined as one display unit, as shown in FIG. 16, a selector 24 having one input and three outputs is provided for each display unit of the neighboring R, G and B. In this display, time-series signal voltages Vsig_R, Vsig_G and Vsig_B for R, G and B, respectively, are input from the data line drive circuit 22 to the selector 24, and the selector 24 is selectively driven sequentially by select signals TR, TG and TB corresponding to R, G and B. Thus, the signal voltages Vsig_R, Vsig_G and Vsig_B are sequentially sampled for data lines 17R, 17G and 17B, respectively, within one horizontal period.

Figure 17:
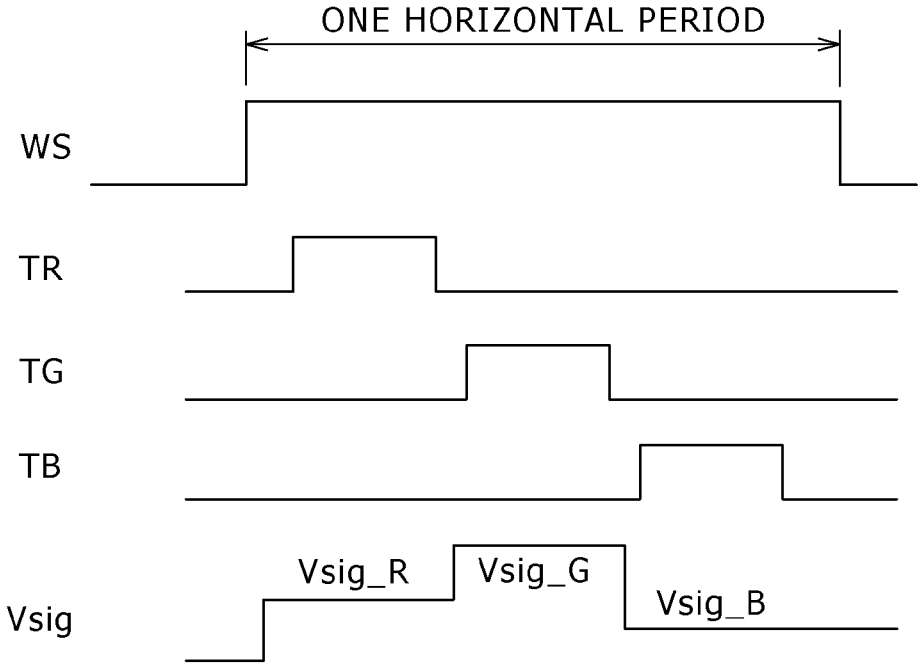
FIG. 17 is a timing chart for explaining the operation of a display that employs a three-time writing system.

In a display that employs a multiple writing system for writing a signal voltage Vsig plural times in one horizontal period in this manner, as is apparent from the timing chart of FIG. 17, a long period cannot be assured as the mobility correction period that is kept in an end part of one horizontal period, and hence the signal voltages Vsig_R, Vsig_G and Vsig_B cannot be changed in the mobility correction period, which makes it difficult to execute writing plural times within one horizontal period. Furthermore, as the number of times of writing becomes larger, it becomes more difficult to assure the mobility correction period.

Second Embodiment

Figure 18:
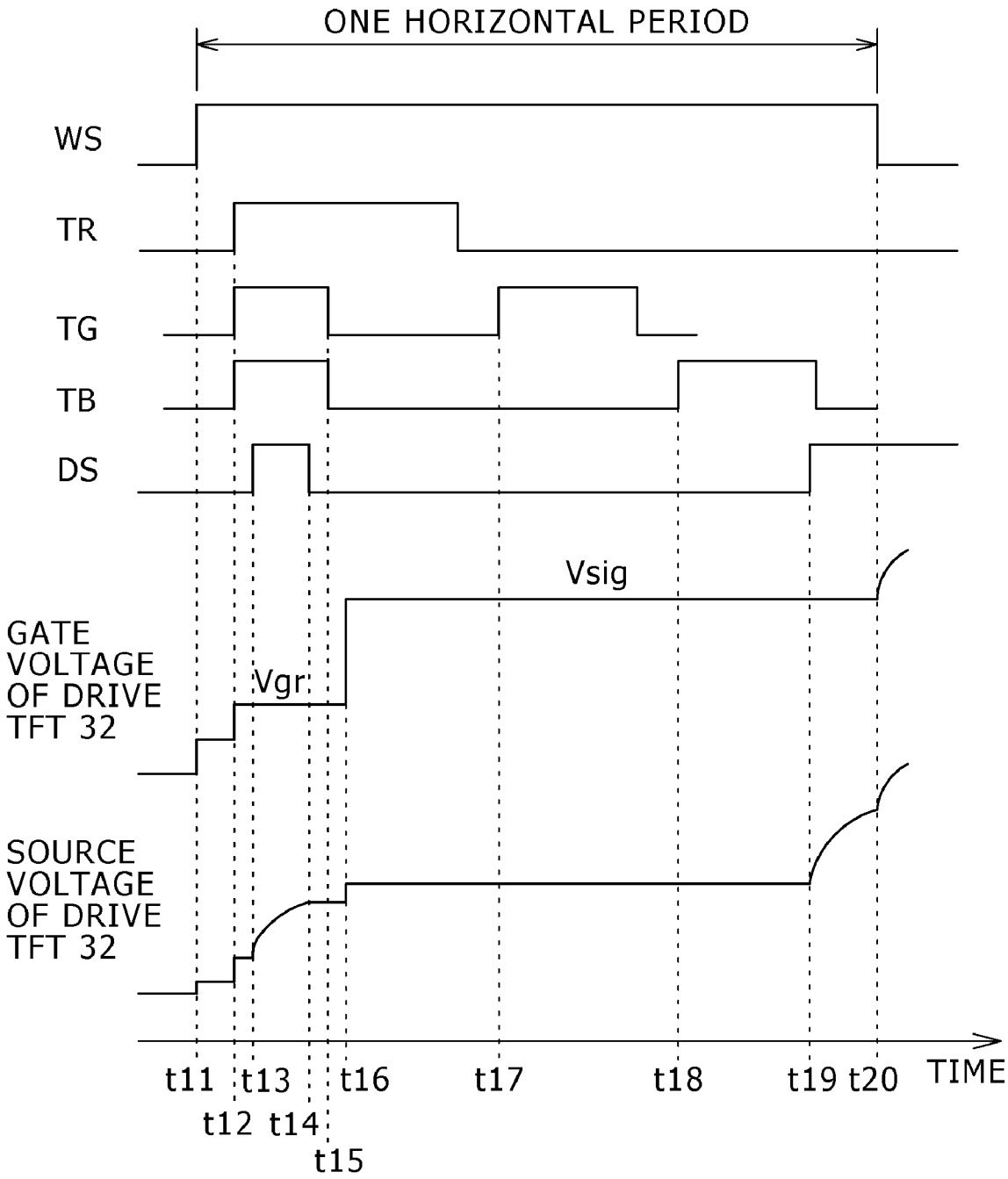
FIG. 18 is a timing chart showing drive timing according to a second embodiment of the invention.

To address this problem, in an organic EL display according to a second embodiment of the invention, two-stage mobility correction is implemented in the following manner as shown in the timing chart of FIG. 18. Specifically, mobility correction with an intermediate grayscale is executed in the first half of a horizontal period during which the signal voltages Vsig_R, Vsig_G and Vsig_B are written (horizontal writing period), specifically, is executed at the beginning of the horizontal writing period. Subsequently, mobility correction with the signal voltages Vsig_R, Vsig_G and Vsig_B is executed in the latter half of the horizontal writing period, specifically, is executed at the end of the horizontal writing period.

Also in the organic EL display of the present embodiment, the write scanning circuit 18 and the drive scanning circuit 19 correspond to the driver set forth in the claims.

The operation in one horizontal period will be described below with reference to the timing chart of FIG. 18.

Initially, the write signal WS is turned to the "H" level at time t11 (corresponding to the time t5 in FIG. 12), which starts a writing period (one horizontal period) during which the signal voltage Vsig (Vsig_R, Vsig_G, Vsig_B) is written. In the horizontal writing period, the data line drive circuit 22 first outputs e.g. a gray level Vgr as an intermediate grayscale level before outputting of the signal voltage Vsig.

Subsequently, the select signals TR, TG and TB are turned to the "H" level at time t12, so that the selector 24 supplies the gray level Vgr to the respective data lines 17R, 17G and 17B of R, G and B in common. Thus, the gray level Vgr is written to the respective pixel circuits 11R, 11G and 11B of R, G and B.

Subsequently, at time t13, the drive signal DS is switched to the "H" level, and hence the switching TFT 34 is turned on, which starts first mobility correction, i.e., mobility correction operation with the intermediate grayscale. Thereafter, the drive signal DS is changed from the "H" level to the "L" level at time t14, which completes the first mobility correction operation. At this time, if the source voltage of the drive TFT 32 is lower than the sum between the threshold voltage Vthel and the cathode voltage Vcat of the organic EL element 31, a current does not flow through the organic EL element 31, and therefore the source voltage of the drive TFT 32 is kept constant.

After the completion of the first mobility correction operation, the select signals TG and TB are changed from the "H" level to the "L" level at time t15. Subsequently, at time t16, the signal voltage Vsig, i.e., the respective signal voltages Vsig_R, Vsig_G and Vsig_B of R, G and B, are time-sequentially output from the data line drive circuit 22 instead of the gray level Vgr.

Since the select signal TR is kept at the "H" level at the time t16, the signal voltage Vsig_R is selected by the selector 24 so as to be written to the pixel circuit 11R at the time t16. Subsequently, the select signal TG is turned to the "H" level at time t17, so that the signal voltage Vsig_G is selected by the selector 24 and is written to the pixel circuit 11G. Thereafter, the select signal TB is turned to the "H" level at time t18, so that the signal voltage Vsig_B is selected by the selector 24 and is written to the pixel circuit 11B.

After the writing of the signal voltage Vsig_B has been completed, the drive signal DS is switched to the "H" level at time t19, and hence the switching TFT 34 is turned on, which starts second mobility correction, i.e., mobility correction operation with the signal voltage Vsig. During this mobility correction, the current flowing through the drive TFT 32 reflects the carrier mobility μ of the drive TFT 32. Thus, the gate-source voltage Vgs of the drive TFT 32 decreases in such a manner as to reflect the mobility μ, and becomes a voltage value Vgs' that offers complete correction of the mobility μ, after a certain period has elapsed.

At time t20 (corresponding to the time t7 in FIG. 12), the write signal WS is changed from the "H" level to the "L" level, which turns off the sampling TFT 33. Thus, the writing period for the signal voltage Vsig finishes, and simultaneously an emission period starts since the switching TFT 34 is kept in the on-state. At this time, since the gate-source voltage Vgs of the drive TFT 32 is constant, the drive TFT 32 supplies the constant current Ids" to the organic EL element 31. As a result, the organic EL element 31 starts light emission operation.

As described above, in the second embodiment, two-stage mobility correction is executed in the following manner. Specifically, mobility correction with an intermediate grayscale is carried out at the beginning of one horizontal period during which the signal voltages Vsig_R, Vsig_G and Vsig_B are written, followed by mobility correction with the signal voltages Vsig_R, Vsig_G and Vsig_B at the end of the horizontal writing period. Such operation eliminates the need to change the signal voltages Vsig_R, Vsig_G and Vsig_B in an end part of one horizontal period unlike the first embodiment. Therefore, also in a display that employs a multiple writing system for writing the signal voltage Vsig plural times in one horizontal period, variation in the mobility μ from pixel to pixel can be corrected for all the grayscales within a constant mobility correction period.

Application Example of Second Embodiment

Figure 19:
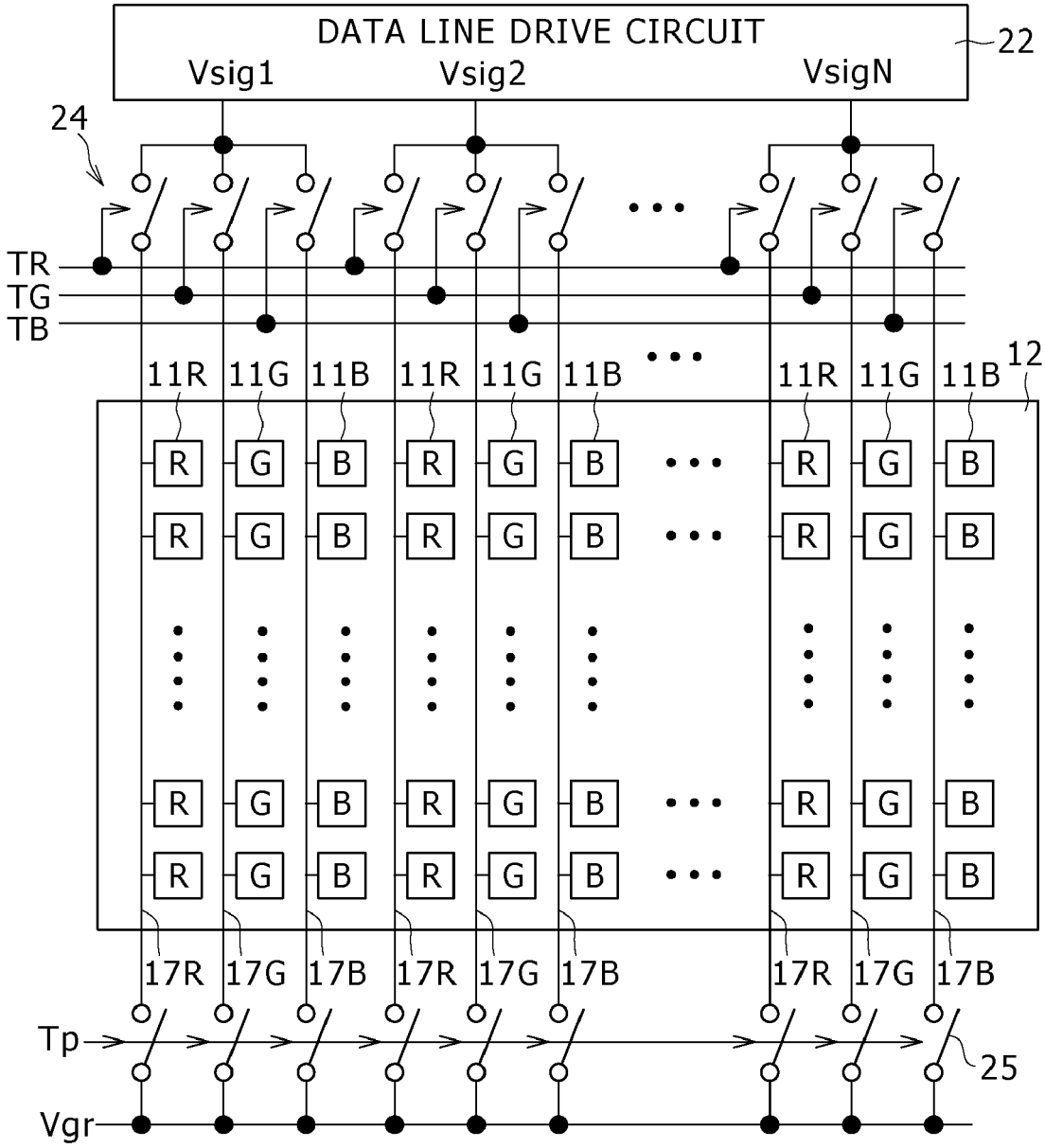
FIG. 19 is a circuit diagram showing the configuration of major part of a display according to an application example of the second embodiment.
Figure 20:
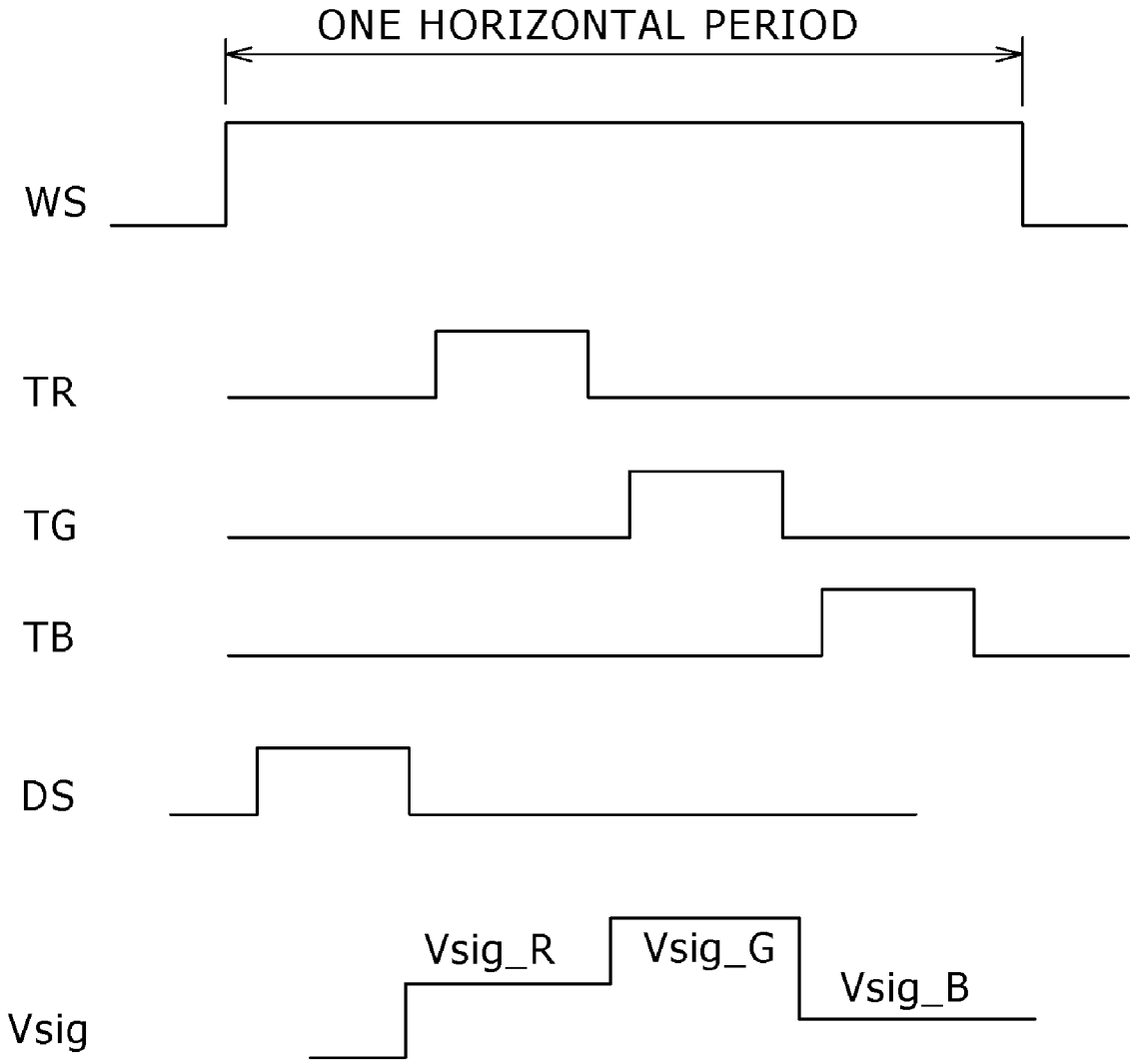
FIG. 20 is a timing chart for explaining the operation of the display of the application example.

In the present embodiment, an intermediate grayscale level is supplied from the data line drive circuit 22 via the selector 24 to the data line 17. Alternatively, another configuration is also available in which, as shown in FIG. 19, precharge switches 25 are connected to e.g. the ends of the data lines 17 on the opposite side of the data line drive circuit 22 and an intermediate grayscale level is selectively supplied to the data lines 17 via the precharge switches 25. In this configuration, switching on/off of the precharge switches 25 is controlled by a precharge signal Tp that is active in the first half of the horizontal writing period as shown in FIG. 20.

The employment of the configuration to supply an intermediate grayscale level with use of the precharge switches 25 eliminates the need for the selector 24 to execute the operation for writing the intermediate grayscale level, and therefore offers advantages that a margin for the period for writing the signal voltages Vsig_R, Vsig_G and Vsig_B can be increased, and that power consumption of the selector 24 can be suppressed.

Third Embodiment

Figure 21:
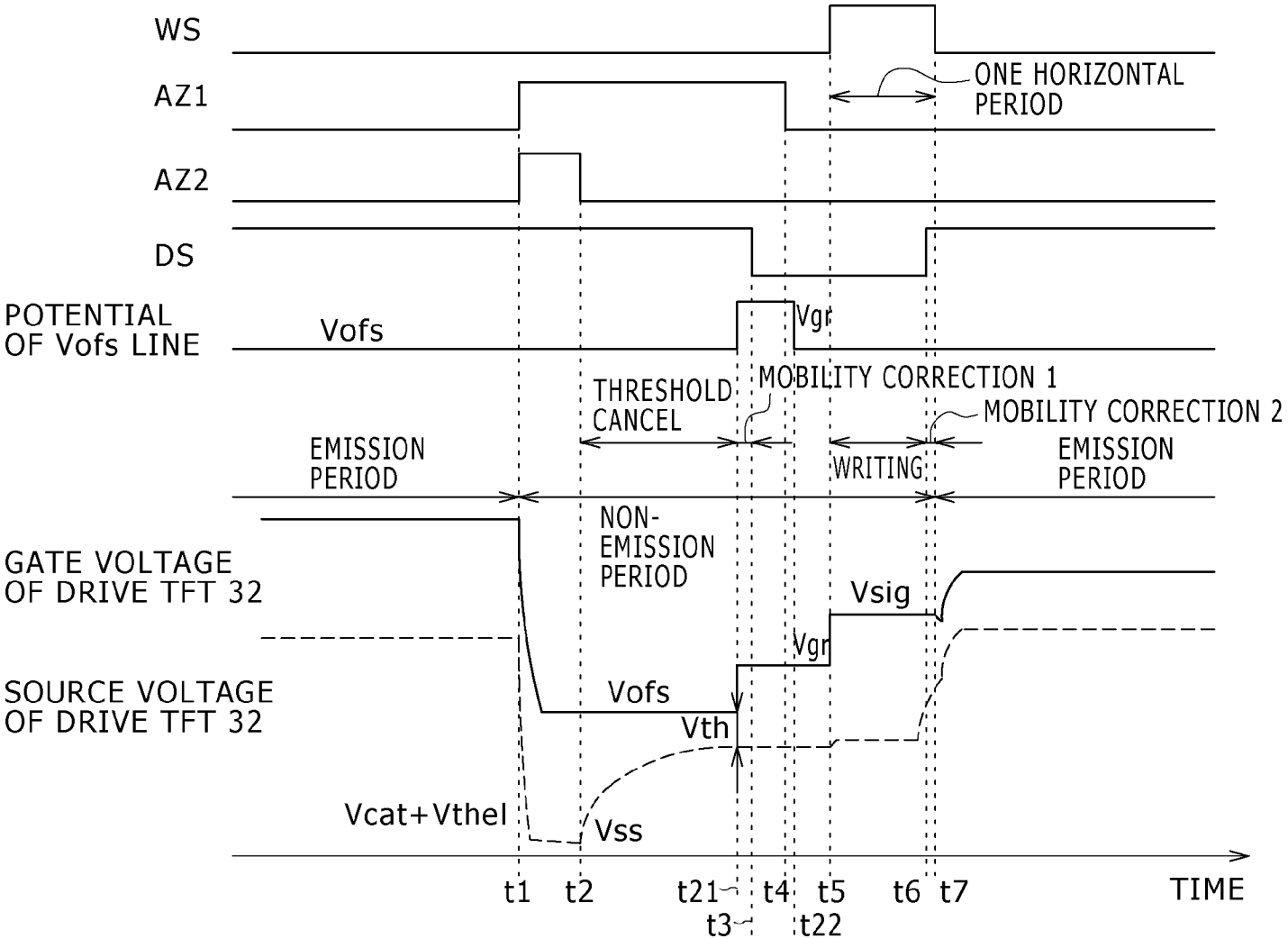
FIG. 21 is a timing chart showing drive timing according to a third embodiment of the invention.

In a third embodiment of the invention, in order to realize mobility correction for all the grayscales within a constant mobility correction period also in a display that employs a multiple writing system for writing a signal voltage Vsig plural times in one horizontal period similarly to the second embodiment, the drive timing shown in FIG. 21 is employed for two-stage mobility correction.

Specifically, a display according to the third embodiment is configured so that the potential (third supply potential) of a supply line for supplying a predetermined potential Vofs (hereinafter, referred to as Vofs line) can selectively take one of binary values of the predetermined potential Vofs and a potential Vgr corresponding to an intermediate grayscale level (hereinafter, referred to as intermediate grayscale potential Vgr). Furthermore, in this display, when the switching TFT 35 is in the on-state, the potential of the Vofs line is switched from the predetermined potential Vofs to the intermediate grayscale potential Vgr after threshold cancel operation to thereby implement first mobility correction, followed by second mobility correction at the end of the horizontal writing period.

The switching of the potential of the Vofs line is carried out by a power supply circuit (not shown) that supplies the Vofs line with a supply voltage. In addition, the two-stage mobility correction operation is executed under control by the write scanning circuit 18 that drives the sampling TFT 33 to be turned on/off, the drive scanning circuit 19 that drives the switching TFT 34 to be turned on/off, and the first auto-zero circuit 20 that drives the switching TFT 35 to be turned on/off. Therefore, in the organic EL display of the present embodiment, the write scanning circuit 18, the drive scanning circuit 19, the first auto-zero circuit 20, and the above-described power supply circuit correspond to the driver set forth in the claims.

The mobility correction operation of the third embodiment will be described below with reference to the timing chart of FIG. 21. Note that the threshold cancel operation and the previous operation in the third embodiment are the same as those in the first embodiment, and hence the description therefor will be omitted to avoid the overlap. Furthermore, time t1 to time t7 in FIG. 21 correspond to the time t1 to the time t7 in FIG. 12, respectively.

At time t21, the potential of the Vofs line is switched from the predetermined potential Vofs to the intermediate grayscale potential Vgr, which ends the threshold cancel operation and starts the first mobility correction operation. Specifically, when the potential of the Vofs line is switched to the intermediate grayscale potential Vgr, the intermediate grayscale potential Vgr is written to the gate of the drive TFT 32 via the switching TFT 35, so that mobility correction with the intermediate grayscale is implemented.

Subsequently, the drive signal DS is changed from the "H" level to the "L" level at the time t3, which completes the first mobility correction operation. At this time, if the source voltage of the drive TFT 32 is lower than the sum between the threshold voltage Vthel and the cathode voltage Vcat of the organic EL element 31, a current does not flow through the organic EL element 31, and therefore the source voltage of the drive TFT 32 is kept constant. Thereafter, the auto-zero signal AZ1 is changed from the "H" level to the "L" level at the time t4, and then the potential of the Vofs line is switched from the intermediate grayscale potential Vgr to the predetermined potential Vofs at time t22.

Subsequently, at the time t5, the write signal WS is switched to the "H" level and hence the sampling TFT 33 enters the on-state, which starts the horizontal writing period for the signal voltage Vsig. If e.g. the above-described three-time writing system is employed, in this horizontal writing period, the respective signal voltages Vsig_R, Vsig_G and Vsig_B of R, G and B are sequentially written in one horizontal period.

After the desired signal voltage Vsig has been written to the gate of the drive TFT 32, the drive signal DS is turned to the "H" level at the time t6 in the latter half of the horizontal writing period, which starts the second mobility correction operation, i.e., mobility correction operation with the desired signal voltage Vsig. During this mobility correction, the current flowing through the drive TFT 32 reflects the carrier mobility μ of the drive TFT 32. Thus, the gate-source voltage Vgs of the drive TFT 32 decreases in such a manner as to reflect the mobility μ, and becomes a voltage value Vgs' that offers complete correction of the mobility μ, after a certain period has elapsed.

At the time t7, the write signal WS is changed from the "H" level to the "L" level, which turns off the sampling TFT 33. Thus, the writing period for the signal voltage Vsig finishes, and simultaneously an emission period starts since the switching TFT 34 is kept in the on-state. At this time, since the gate-source voltage Vgs of the drive TFT 32 is constant, the drive TFT 32 supplies the constant current Ids" to the organic EL element 31. As a result, the organic EL element 31 starts light emission operation.

As described above, in the third embodiment, two-stage mobility correction is executed in the following manner. Specifically, the potential of the Vofs line is allowed to be switched between the predetermined potential Vofs and the intermediate grayscale potential Vgr. Based on this configuration, the potential of the Vofs line is switched to the intermediate grayscale potential Vgr after threshold cancel operation to thereby execute first mobility correction, followed by second mobility correction at the end of the horizontal writing period. Due to this operation, also in a display that employs a multiple writing system, variation in the mobility μ from pixel to pixel can be corrected for all the grayscales within a constant mobility correction period.

In addition, since the number of times of mobility correction in one horizontal period is only one, a margin for the writing period for the signal voltages Vsig_R, Vsig_G and Vsig_B can be increased. Moreover, since the selector 24 does not need to execute the operation for writing an intermediate grayscale level, power consumption of the selector 24 can be suppressed.

Application Example of Third Embodiment

In the present embodiment, the first mobility correction is implemented by switching the potential of the Vofs line to the intermediate grayscale potential Vgr after threshold cancel operation. Alternatively, another configuration is also available in which, similarly to the application example of the second embodiment (see FIG. 19), precharge switches 25 are connected to e.g. the ends of the data lines 17 on the opposite side of the data line drive circuit 22 and an intermediate grayscale level is selectively supplied to the data lines 17 via the precharge switches 25.

Figure 22:
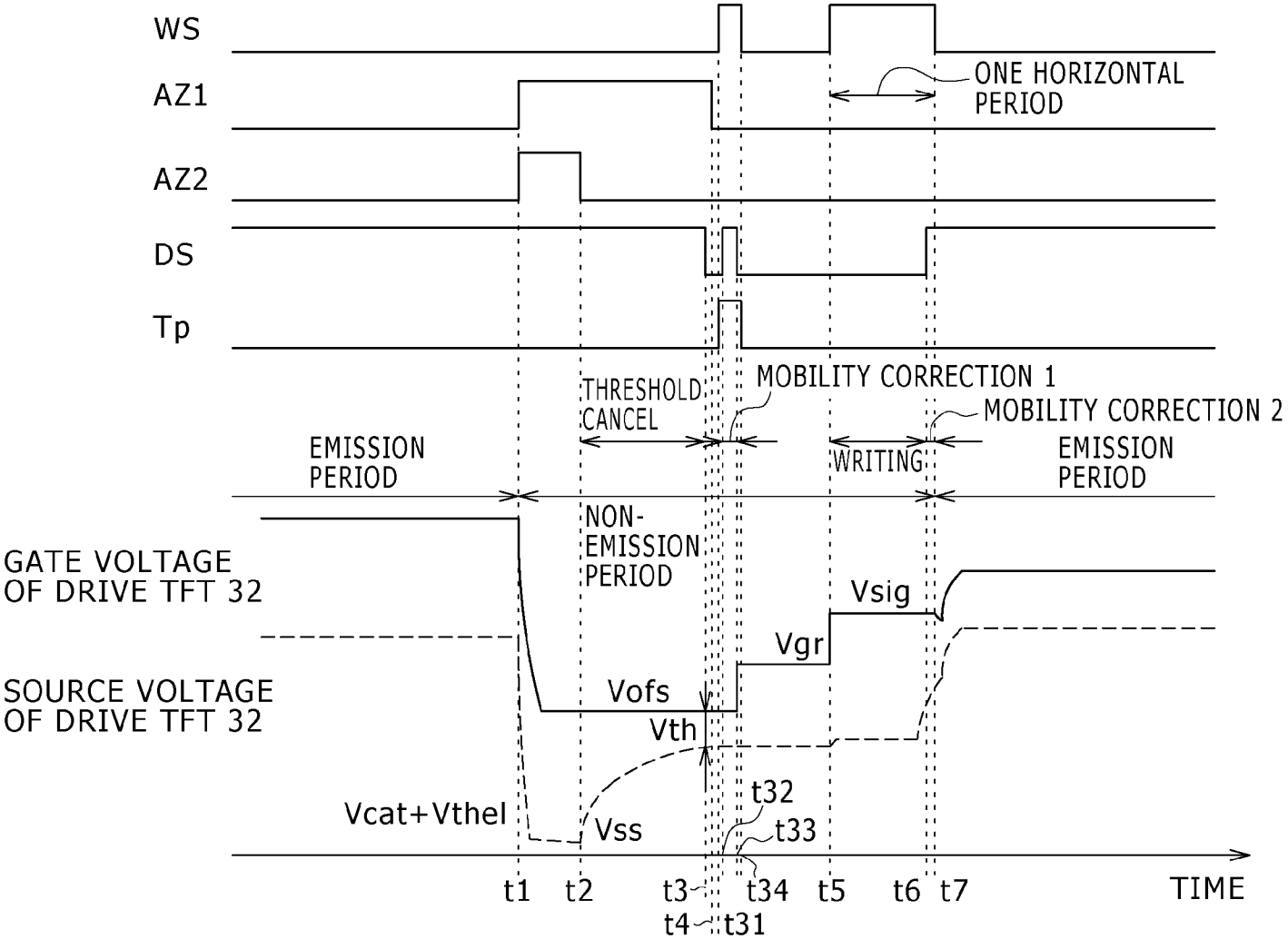
FIG. 22 is a timing chart showing drive timing according to an application example of the third embodiment.

The mobility correction operation of this application example will be described below with reference to the timing chart of FIG. 22. Note that the threshold cancel operation and the previous operation in the application example are the same as those in the first embodiment, and hence the description therefor will be omitted to avoid the overlap. Furthermore, time t1 to time t7 in FIG. 22 correspond to the time t1 to the time t7 in FIG. 12, respectively.

The threshold cancel operation ends at the time t3, and then the auto-zero signal AZ1 is turned to the "L" level at the time t4. Subsequently, the write signal WS and a precharge signal Tp are turned to the "H" level at time t31. Thus, an intermediate grayscale potential (potential corresponding to an intermediate grayscale level) Vgr is supplied via the precharge switches 25 to the data lines 17R, 17G and 17B, followed by being written via the sampling TFTs 33 to the gates of the drive TFTs 32.

Subsequently, at time t32, the drive signal DS is switched to the "H" level, and hence the switching TFT 34 is turned on, which starts first mobility correction, i.e., mobility correction with the intermediate grayscale. Thereafter, the drive signal DS is changed from the "H" level to the "L" level at time t33, which completes the first mobility correction operation.

After the completion of the first mobility correction operation, the write signal WS and the precharge signal Tp are changed from the "H" level to the "L" level at time t34. Subsequently, at the time t5, the write signal WS is switched to the "H" level and hence the sampling TFT 33 enters the on-state, which starts the horizontal writing period for the signal voltage Vsig. If e.g. the above-described three-time writing system is employed, in this horizontal writing period, the respective signal voltages Vsig_R, Vsig_G and Vsig_B of R, G and B are sequentially written in one horizontal period.

After the desired signal voltage Vsig has been written to the gate of the drive TFT 32, the drive signal DS is turned to the "H" level at the time t6 in the latter half of the horizontal writing period, which starts the second mobility correction operation, i.e., mobility correction operation with the desired signal voltage Vsig. During this mobility correction, the current flowing through the drive TFT 32 reflects the carrier mobility μ of the drive TFT 32. Thus, the gate-source voltage Vgs of the drive TFT 32 decreases in such a manner as to reflect the mobility μ, and becomes a voltage value Vgs' that offers complete correction of the mobility μ, after a certain period has elapsed.

As described above, in the application example, two-stage mobility correction is executed in the following manner. Specifically, the precharge switches 25 are connected to the data lines 17, and an intermediate grayscale level is selectively supplied via the precharge switches 25 to the data lines 17 after threshold cancel operation to thereby implement first mobility correction, followed by second mobility correction at the end of the horizontal writing period. Due to this configuration, similar operation and advantages to those in the third embodiment can be achieved. In addition, two-stage mobility correction can be implemented even in a display that includes pixel circuits each having no Vofs line.

In the above descriptions of the respective embodiments, explanations have been made on examples of application to an organic EL display that employs organic EL elements as electro-optical elements in the pixel circuits 11. However, the present invention is not limited to these application examples but can be applied to overall displays that employ current-driven light-emitting elements of which emission luminance varies depending on the current value.

Furthermore, in the above descriptions of the embodiments, explanations have been made on examples in which N-channel TFTs are used as the drive transistor 32, the sampling transistor 33, and the switching transistors 34 to 36 included in each pixel circuit 11. However, the sampling transistor 33 and the switching transistors 34 to 36 do not necessarily need to be N-channel TFTs.

It should be understood by those skilled in the art that various modifications, combinations, sub-combinations and alterations may occur depending on design requirements and other factors insofar as they are within the scope of the appended claims or the equivalents thereof.

What is claimed is:

1. A display comprising:

a pixel array configured to include pixel circuits that are arranged in rows and columns, each of the pixel circuits including an electro-optical element of which one end is connected to a first supply potential, a drive transistor that has a source connected to the other end of the electro-optical element and is formed of a thin film transistor, a sampling transistor that is connected between a data line and a gate of the drive transistor and captures an input signal dependent upon luminance information from the data line, a first switching transistor connected between a drain of the drive transistor and a second supply potential, a second switching transistor connected between the gate of the drive transistor and a third supply potential, a third switching transistor connected between the source of the drive transistor and a fourth supply potential, and a capacitor connected between the gate and the source of the drive transistor; and a driver configured to execute first mobility correction operation for correcting variation in a mobility of the drive transistor by writing an intermediate grayscale level to the gate of the drive transistor when the first switching transistor is in a conducting state, and execute after the first mobility correction operation, second mobility correction operation for correcting variation in the mobility of the drive transistor by writing the input signal to the gate of the drive transistor when the first switching transistor is in a conducting state.

2. The display according to claim 1, wherein the driver is allowed to adjust a period during which the intermediate grayscale level is written.

3. The display according to claim 1, wherein the input signal is written to each pixel circuit on a selected row a plurality of times in one horizontal period.

4. The display according to claim 1, wherein the intermediate grayscale level is written through the data line.

5. The display according to claim 4, further comprising a precharge switch configured to be connected to the data line, wherein the intermediate grayscale level is supplied to the data line through the precharge switch.

6. The display according to claim 3, wherein the third supply potential selectively takes one of binary values of a predetermined potential and a potential corresponding to the intermediate grayscale level, and in the first mobility correction operation, the driver switches the third supply potential to the potential corresponding to the intermediate grayscale level when the second switching transistor is in a conducting state to thereby write the potential to the gate of the drive transistor.

7. A method for driving a display including pixel circuits that are arranged in rows and columns and each have an electro-optical element of which one end is connected to a first supply potential, a drive transistor that has a source connected to the other end of the electro-optical element and is formed of a thin film transistor, a sampling transistor that is connected between a data line and a gate of the drive transistor and captures an input signal dependent upon luminance information from the data line, a first switching transistor connected between a drain of the drive transistor and a second supply potential, a second switching transistor connected between the gate of the drive transistor and a third supply potential, a third switching transistor connected between the source of the drive transistor and a fourth supply potential, and a capacitor connected between the gate and the source of the drive transistor, the method comprising the steps of:

executing first mobility correction operation for correcting variation in a mobility of the drive transistor by writing an intermediate grayscale level to the gate of the drive transistor when the first switching transistor is in a conducting state; and after the first mobility correction operation, executing second mobility correction operation for correcting variation in the mobility of the drive transistor by writing the input signal to the gate of the drive transistor when the first switching transistor is in a conducting state.

8. A display comprising:

a pixel array configured to include pixel circuits that are arranged in rows and columns, each of the pixel circuits including an electro-optical element of which one end is connected to a first supply potential, a drive transistor that has a source connected to the other end of the electro-optical element and is formed of a thin film transistor, a sampling transistor that is connected between a data line and a gate of the drive transistor and captures an input signal dependent upon luminance information from the data line, a first switching transistor connected between a drain of the drive transistor and a second supply potential, a second switching transistor connected between the gate of the drive transistor and a third supply potential, a third switching transistor connected between the source of the drive transistor and a fourth supply potential, and a capacitor connected between the gate and the source of the drive transistor; and a driver configured to execute first mobility correction operation for correcting variation in a mobility of the drive transistor by writing an intermediate grayscale level to the gate of the drive transistor when the first switching transistor is in a conducting state, and execute after the first mobility correction operation, second mobility correction operation for correcting variation in the mobility of the drive transistor by writing the input signal to the gate of the drive transistor when the first switching transistor is in a conducting state wherein, the input signal is written to each pixel circuit on a selected row a plurality of times in one horizontal period; and the driver executes the first mobility correction operation in a first half of a horizontal writing period during which the sampling transistor is in a conducting state, and executes the second mobility correction operation in a latter half of the horizontal writing period.

* * * * *